US006178956B1

(12) United States Patent
Steinmann et al.

(10) Patent No.: US 6,178,956 B1
(45) Date of Patent: Jan. 30, 2001

(54) AUTOMOTIVE FLUID CONTROL SYSTEM WITH PRESSURE BALANCED SOLENOID VALVE

(75) Inventors: Christian Steinmann, Essen (DE); Michael J. Covey, Steerling, IL (US); Thomas D. Herrington, Heidelberg (DE); Michael T. Clark, Polo; John W. Dillon, Franklin Grove, both of IL (US); Steven J. Roskowski, Farmington Hills; Keith D. Marsh, St. Clair Shores, both of MI (US)

(73) Assignee: BorgWarner Inc., Troy, MI (US)

( * ) Notice: Under 35 U.S.C. 154(b), the term of this patent shall be extended for 0 days.

(21) Appl. No.: 09/194,346

(22) PCT Filed: May 20, 1997

(86) PCT No.: PCT/US97/08553

§ 371 Date: Mar. 31, 1999

§ 102(e) Date: Mar. 31, 1999

(87) PCT Pub. No.: WO97/44580

PCT Pub. Date: Nov. 27, 1997

Related U.S. Application Data

(60) Provisional application No. 60/019,044, filed on May 20, 1996, and provisional application No. 60/022,948, filed on Aug. 2, 1996.

(51) Int. Cl.[7] ..... F02M 25/07

(52) U.S. Cl. ..... 123/568.21; 251/129.07

(58) Field of Search ..... 123/568.21, 568.26; 73/118.1; 324/202, 207.24; 251/129.07, 129.15

(56) References Cited

U.S. PATENT DOCUMENTS

| | | | | |
|---|---|---|---|---|
| 3,982,515 | | 9/1976 | Bradshaw . | |
| 4,315,523 | * | 2/1982 | Mahawili et al. | 137/486 |
| 4,378,777 | | 4/1983 | Iida et al. . | |
| 4,617,889 | | 10/1986 | Nishimiya et al. . | |
| 4,662,604 | | 5/1987 | Cook . | |
| 4,796,854 | | 1/1989 | Ewing . | |
| 4,858,886 | | 8/1989 | Tatara . | |
| 5,255,659 | | 10/1993 | Choma . | |
| 5,573,032 | * | 11/1996 | Lenz et al. | 137/486 |
| 5,577,484 | | 11/1996 | Izutani et al. . | |
| 5,701,874 | * | 12/1997 | Sari et al. | 123/568.21 |

* cited by examiner

*Primary Examiner*—Henry C. Yuen
*Assistant Examiner*—Arnold Castro
(74) *Attorney, Agent, or Firm*—Lyon & Artz PLC; Greg Dziegielewski

(57) ABSTRACT

An automotive fluid control system with pressure balanced solenoid valve [24] and fluid mixing housing [22] is disclosed. The solenoid valve [24] is preferably used in an EGR (exhaust gas circulation) fluid control system, although the valve may be used in other vehicle fluid control systems, such as an engine block cooling liquid control system. A poppet member [84] of an EGR valve is pressured balanced such that only a light spring [170] and armature [88] are needed to control the positioning of the poppet member [84]. Magnetic and inductance sensors [184, 282] are used to accurately determine the position of the poppet member. The fluid mixing housing [22] homogeneously mixes first and second fluids. A portion of a main first fluid flow is funneled off and mixed in the housing [22] with a second fluid prior to being returned to the main fluid flow. Ideally, the housing [22] has a circumferentially extending channel [95] for intercepting, funnelling and mixing the captured portion of the main first fluid flow with the second fluid flow. Also, a solenoid subassembly [82] is disclosed which can mate with a variety of different valve housings [22] and which is adapted to mount on various engine configurations.

28 Claims, 16 Drawing Sheets

AUTOMOTIVE FLUID CONTROL SYSTEM WITH PRESSURE BALANCED SOLENOID VALVE

The present application is a continuation-in-part of U.S. Provisional application Ser. No. 60/019,044, filed on May 20, 1996, which is a continuation-in-part of U.S. Provisional application Ser. No. 60/022,948, filed on Aug. 2, 1996.

TECHNICAL FIELD

This invention relates to solenoid valves and fluid control systems for use in automobiles and other vehicles, one preferred system being a solenoid operated exhaust gas recirculation system for internal combustion engine.

BACKGROUND OF THE INVENTION

Fluid control valves and fluid flow systems are used throughout an automobile to control the flow of fluids. Examples of fluid flow systems include (a) air and exhaust gas recirculation (EGR) flow to combustion chambers or cylinders of an internal combustion engine, (b) water flow to control the cooling of an internal combustion engine, and (c) warm/cool air flow to moderate the temperature within the passenger compartment of a vehicle. These fluid flows are typically controlled by fluid control valves, especially solenoid operated valves.

It is now customary to utilize exhaust gas recirculation in the fuel management system of automotive internal combustion engines to reduce the amount of pollutants in the exhaust gas and to improve fuel economy. This is accomplished by capturing a portion of the exhaust gas and combining the captured exhaust gas with an air/fuel charge for the internal combustion engine. If the balance between the air, fuel and exhaust gas is such that an ideal stoichiometric mixture is achieved, then maximum power is produced while utilizing a minimum amount of fuel and creating a minimum amount of pollutants.

More specifically, incorporating exhaust gas into fuel and air being burned in combustion chambers is helpful for several reasons. First, pollutants, particularly nitrous oxides (NOx), are more susceptible to being produced when temperatures in combustion chambers are high. Exhaust gas has a higher specific heat than air and therefore the presence of exhaust gas in place of air assists in lowering temperatures in combustion chambers.

When less than full power from an engine is needed, the combustion chambers do not need a full compliment of air since a reduced amount of fuel is typically supplied to them. Accordingly, exhaust gas replaces a portion of the air such that the lesser amounts of fuel and air are again stoichiometrically balanced. With less air and fuel being burned, the amount of heat produced will be less, again keeping the temperature in the combustion chambers at a lower level and the amount of pollutants produced down.

Further, adding exhaust gas to intake air reduces the amount of work an engine must perform. The exhaust gas is generally at a positive pressure relative to the intake air. Therefore, the addition of this exhaust gas to intake air reduces the amount of vacuum which must be created by pistons to draw gases into the cylinders.

Care must be taken, however, not to provide an overabundance of exhaust air into the fuel/air/exhaust gas mixture. If too much exhaust gas is introduced, the engine can run roughly. Accordingly, the fuel/air/exhaust gas mixture introduced into the combustion chambers are typically controlled to insure that there is an overabundance of fuel and air at the expense of not supplying an optimal amount of exhaust gas. Looking to FIG. 1, curves 16A–D represent percentage maximum engine torque versus engine RPM for a variety of percentage throttle open positions. Encircled area 17 represents the theoretical portion of the graph in which exhaust gas should be added to intake air to achieve optimal gas mileage and reduced pollutants. Encircled area 18 shows a much reduced portion of encircled area 17 in which conventional engines are conservatively operated. Area 19, as discussed in more detail below, illustrates the general area of performance of the present invention. Thus, internal combustion engines today are not operated as efficiently as possible. This is in large part due to the present inability of solenoid valve mechanisms to precisely control the introduction of exhaust gas into an ambient air stream which is then directed to one or more combustion chambers for burning with fuel.

An exhaust gas recirculation valve of a poppet type is often used to provide some control of the amount of exhaust gas that is captured and returned to the internal combustion engine for reburning. In one known system, a mechanically actuated poppet valve has been used in which an electrical control signal controls a vacuum motor which, in turn, actuates a poppet valve member. However, the response of the vacuum motor-actuated poppet valve member is often too slow to precisely control the input of exhaust gas into intake air even when it is controlled by an electronic signal.

Some EGR systems utilize solenoid actuated poppet valve members to provide a quicker response. See for instance, U.S. Pat. Nos. 4,805,582, 4,961,413 and 5,094,218. However, as demonstrated by these patents, the pressure of the exhaust gas in known solenoid actuated EGR valves supplies forces tending to open the poppet valves members which are held in the closed position by spring mechanisms. This is a drawback because the arrangement requires the use of heavy springs to insure that the poppet valve members do not lift from their valve seats when the pressure of the exhaust gas is high, such as during engine backfire or under other engine load conditions.

Furthermore, since the solenoid activated EGR valve systems must overcome the heavy closing spring forces to open poppet valve members, relatively larger solenoids are required, which result in increased size and weight penalties for the systems. These penalties are important factors, particularly in automotive applications where weight affects fuel economy to such an extent that there are continuous and unrelenting ongoing efforts today to reduce weight.

Moreover, because springs, poppet valve members, and armatures in known systems are large and heavy, significant amounts of current must be supplied to the solenoids to overcome the large spring forces and open the poppet valve members. This, in turn, increases the load on the electrical system of the vehicle.

Finally, known EGR valves employing solenoids are often difficult to control. First, because of the relatively heavy or massive components used in constructing the EGR valves, the response time for armature and poppet valve member control can be slow. Also, vibration due to engine operation and vehicle bounce due to road surface irregularities can cause a massive armature to move independently of the remainder of the EGR valve mounted on a vehicle.

Second, current technology is not well suited to precisely identify the position of a poppet valve member relative to a valve seat. In this regard, the position of the poppet valve member determines the quantity of fluid flow through the EGR valve and is therefore significant. Potentiometer based sensors include a metallic conductor affixed to the housing and at lease one wiper operatively connected to a poppet valve member and/or an armature. The wiper slides relative to non-moving metallic conductors within the EGR valve to determine poppet valve member position. These potentiometer based sensors are susceptible to vehicle vibrations and continuous wear due to cycling of the components. Valves having potentiometer based sensors must be mechanically calibrated and are therefore difficult and time-consuming to calibrate during assembly. Further, their accuracy often significantly deteriorates over the operating life of an EGR valve.

Another problem with current solenoid actuated EGR valves is that they may allow air and exhaust gas to leak along the stems of poppet valve members and into and out of the EGR valves. This leakage detracts from the ability to carefully meter and balance the intakes of ambient air and exhaust gas through the EGR valves.

EGR systems typically contain conduits and orifices of a sufficient size to accommodate large amounts of exhaust gas flow. Looking to FIGS. 2A and 2B, exhaust gas is supplied at a positive pressure $P_P$ relative to atmosphere, when expelled during an exhaust stroke from combustion chamber C and into an exhaust manifold. Intake manifolds generally are at a relative negative pressure, $P_N$, because an air/exhaust gas mixture is drawn into the combustion chambers C during intake strokes of pistons P, as shown in FIG. 2B. Accordingly, the flow of exhaust gas from the exhaust manifold, through an EGR valve V and into the intake manifold, is partially limited by the pressure drop between the manifolds. Therefore, the sizes of the conduits and orifices in the system must be sufficient to provide a desired maximum exhaust gas flow due to the available pressure drop in the exhaust and intake manifolds.

Internal combustion engines are also susceptible to clogging due to accumulation of contaminants and moisture carried by exhaust gases. Exhaust gases often contain heavy particles which can fall or settle out of suspension if fluid flow is too slow, or if the flow passes through a sharp bend. As a result, it is common for contaminants to build up in EGR valves or for heavy particles to accumulate within the intake manifold near the exhaust gas inlet and drop into the first available combustion chamber. Therefore, it is advantageous to mix exhaust gas and ambient air as homogeneously as possible to maintain the heavy particles in fluid suspension prior to entry into the combustion chambers.

Moreover, solenoid actuated EGR valves can fail if they overheat. Insulation on wires and coils of a solenoid can deteriorate if the temperatures in an EGR valve are too high. Therefore, care in design must be taken to insure that EGR valves are not subjected to excessively high temperatures.

Another problem encountered with EGR valves is that they are mounted on a wide variety of engines. Hence, different EGR valve configurations must be made for each different type of engine. This leads to a large amount of design work and a need to secure and keep available a significant inventory of EGR valves with different engine mounts.

Several of the problems with known EGR valves are also present with respect to known valve mechanisms for controlling water flow to cool engines. Solenoid activated valve mechanisms for these systems often are relatively large and massive due to the heavy biasing members and forces necessary to keep the valves closed. These valve mechanisms add undesirable weight to the vehicles, unnecessarily increasing the load on the electrical systems of the vehicles, and are difficult to control with accuracy and precision. The position of a moveable poppet valve member and thus the amount of valve opening and fluid flow is also difficult to control and measure, and can vary over the life of the valve mechanism. These problems may also exist with other vehicle and non-vehicle solenoid controlled valve applications involving fluid flow.

SUMMARY OF THE INVENTION

It is a general object of the present invention to provide an improved solenoid activated valve mechanism for use in fluid flow systems, especially in vehicles. These valve mechanisms have particular use in EGR systems and cooling water flow systems, although the invention is not limited just to use in these systems.

It is a further object of the present invention to provide an exhaust gas recirculation system for an internal combustion engine which utilizes a highly accurate and responsive solenoid operated EGR valve such that the optimal amount of exhaust gas in a fuel/air/exhaust gas mixture can be employed in combustion chambers of an engine thus increasing the fuel economy of the vehicle and reducing pollutants.

Another object of the present invention is to provide a solenoid operated valve member that is light and compact and thus particularly useful in automotive applications.

It is also an object of the present invention to provide a solenoid operated EGR valve which utilizes a pressure balanced valve member and armature such that only a light spring and small solenoid are needed to open and close the valve member and which requires only a limited amount of current to operate.

Another object is to provide a modular type solenoid subassembly which can be assembled, tested and calibrated prior to mounting to one of a plurality of base housings which are specifically configured to mount to a particular engine housing or manifold.

It is yet another object to provide a solenoid activated valve member which uses a more accurate and non-mechanical sensor, to accurately sense the position of a valve member, and which does not require mechanical components which can physically wear out.

It is still another object of the present invention to provide a position sensor in a valve mechanism which can be quickly, inexpensively, and electronically calibrated.

An additional object is to mount a magnet relative to an armature of a solenoid to move with the armature, the magnet being placed outside the flux field of the solenoid valve and adjacent to a Hall effect sensor to determine displacement of the armature as the magnet reciprocates along the Hall effect sensor.

Moreover, it is an additional object of the present invention to provide an improved mixing housing for homogeneously mixing two fluid flows, such as inlet air and recirculated exhaust gas in an EGR system.

It is still a further object of the present invention to provide a modular type pressure balanced solenoid operated EGR valve for incorporation into a diesel engine.

A feature of the present invention is the use of a mixing housing in an EGR system which utilizes a venturi effect to increase exhaust gas flow from an exhaust manifold to an intake manifold.

These and other objects are met with the embodiments of the present invention. Specifically, in accordance with the present invention, a unique solenoid activated fluid flow control valve mechanism is provided, along with a unique housing for homogeneously mixing two fluid flows. The valve mechanism has a pressure balanced armature and valve member which allows use of a light return spring and small solenoid so that the valve mechanism is lighter in weight, smaller and more compact in size, and less expensive to manufacture and operate than conventional solenoid operated valve mechanisms. The valve mechanism reduces the load on the electrical system of the vehicle and can be more precisely operated to more accurately control and record the flow of fluid therethrough. Also, the valve mechanism uses a magnetic flux or electromagnetic field responsive sensor, such as a Hall effect or an inductance sensor, to accurately sense the position of the valve member relative to a valve seat. The sensor has minimal wear and minimal reduction in accuracy over its operating life.

In accordance with one aspect of the invention, the solenoid operated valve mechanism preferably has a hollow valve member carried by a hollow armature of the solenoid so that the force of a fluid on a valve member and/or armature is evenly balanced when the valve member is in a closed position preventing fluid flow. The solenoid operated valve mechanism also has an armature which may be part of an expandable chamber fluidly connected to a fluid source (e.g. exhaust gas) when the valve member is closed so that the pressure of the fluid source produces a force component assisting in maintaining the valve member in the closed position. The hollow armature may be piloted on a stem so that the pressure on the valve member is equalized when the valve member is closed. Preferably, the valve member is also pressure balanced when in an open position.

In an alternative embodiment of the invention, the solenoid operated valve mechanism has an expandable mechanism that includes a metallic bellows that provides a spring force and a force component responsive to fluid flow that assists in keeping the valve member in the closed position while providing a sealed chamber preventing fluid from escaping the valve mechanism.

The preferred mixing housing for use with the solenoid activated valve mechanism, particularly when used in an EGR system, is more compact in size than conventional intake air-exhaust gas mixing apparatus and more homogeneously mixes the two fluids. The fluid mixing housing has an inlet channel ideally of diminishing cross-sectional size which intercepts a portion of a first fluid flow and directs it to a mixing chamber. The mixing chamber also receives a second fluid, such as exhaust gas, and is connected to an outlet channel of preferably increasing cross-sectional size. The outlet channel returns the portion of the first flow, which is now homogeneously mixed with the second fluid flow to the first fluid flow. The first fluid flow induces these mixed fluids to be drawn out of the outlet channel. A venturi effect is created in the mixing chamber which increases the pressure drop from an exhaust gas manifold to the mixing chamber and which enhances gas flow in the system without having to increase the size of a conduit carrying exhaust from the exhaust manifold to the intake manifold.

The unique mixing housing, when used as part of an EGR valve mechanism, reduces contamination buildup along the valve seat due to the passing airstream which keeps the exhaust gas particles in suspension and flushes away settled particles. Cooler air also is used to cool down the valve member and thereby reduce temperature migration into other portions of the valve mechanism, such as the solenoid. The housing further utilizes venturi effects to create an additional pressure drop in the mixing housing to enhance fluid flow through the mixing mechanism.

BRIEF DESCRIPTION OF THE DRAWINGS

The above and other objects, features and advantages of the present invention will become more apparent from the following description when taken in conjunction with the accompanying drawings and appended claims.

BEST MODE(S) FOR CARRYING OUT THE INVENTION

As explained in more detail herein, the present invention can be used in a number of different applications particularly involving fluid flow systems for automobiles and other vehicles. For example, the present invention can be used in exhaust gas recirculation (EGR) systems and engine water cooling systems. The present invention can also be used in other comparable or equivalent systems where the benefits and features of the invention can be obtained. For illustration purposes, by way of example and explanation of the features and benefits of the present invention, but not for the purposes of limiting its use or application, the present invention will be explained in particular relative to its use in an EGR system. It should be understood that the present invention is intended for use in all types of engines, including both diesel and non-diesel engines.

Figure 1:
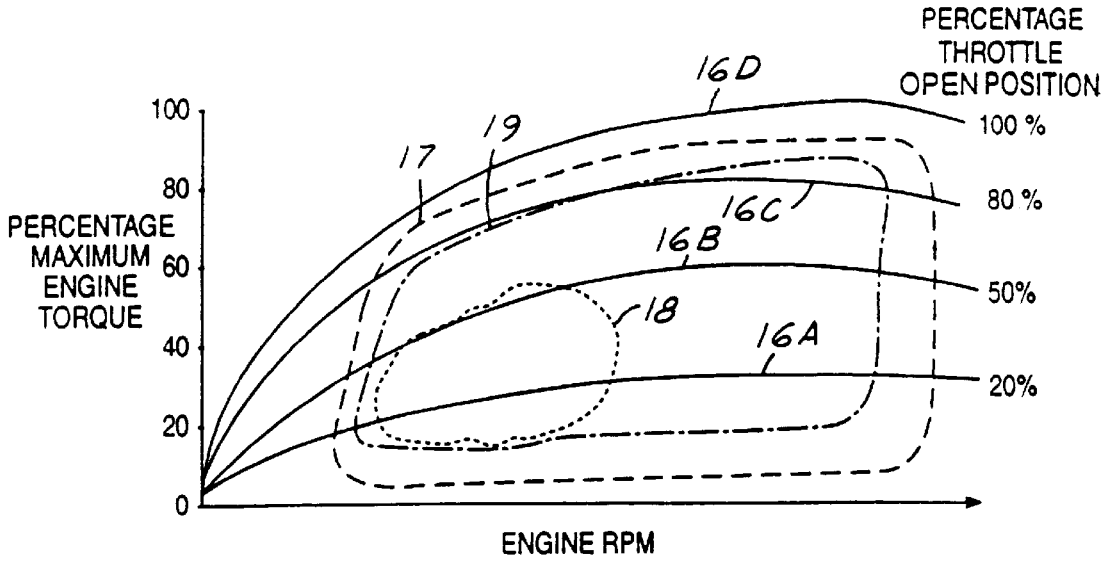
FIG. 1 is a graph of percentage of maximum engine torque versus engine revolutions per minute (RPM) for various throttle-open positions, the graph includes encircled regions showing under what conditions exhaust gas is added to intake air.
Figure 2A:
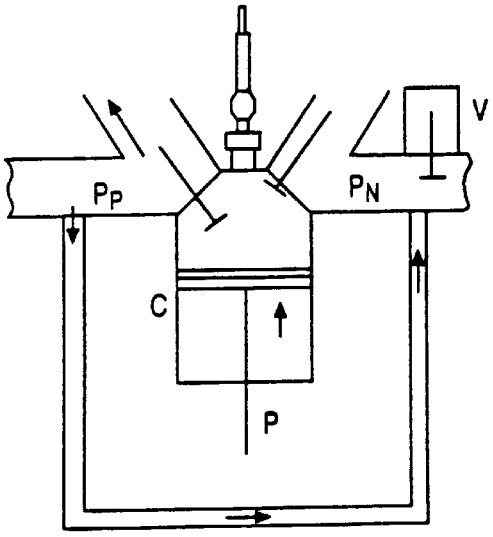
FIGS. 2A and B schematically illustrate respective pistons in combustion chambers expelling exhaust gas and drawing in a mixture of intake air and exhaust gas during exhaust and intake strokes, respectively, of an engine to recirculate exhaust gas in a conventional exhaust gas recirculation system.
Figure 2B:
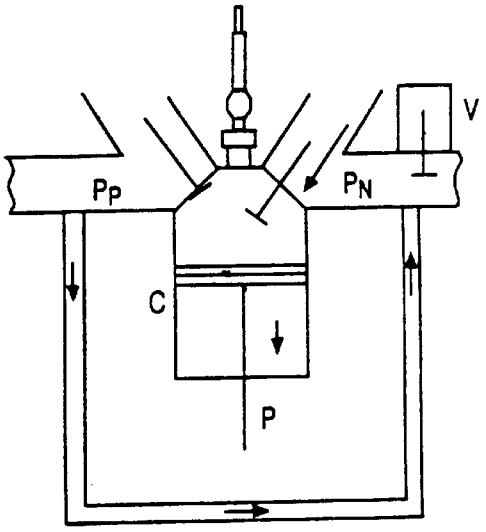

Adding exhaust gas to intake air can be quite beneficial to engine performance, particularly in the areas of enhanced gas mileage and reduction of nitrous oxide ($No_x$) pollutants. FIG. 1 shows a graph of curves 16A–D of the percentage of maximum engine torque versus engine revolutions per minute (RMP) for a variety of throttle positions. The throttle positions are expressed as a percentage of opening, 20%, 50%, 80%, and 100% for respective curves 16A–D, which reflect the throttle's ability to limit intake air into the intake manifold of the engine. As the throttle opening is increased for a given RPM, the torque produced by the engine increases correspondingly.

As indicated in the background, current EGR valves are relatively heavy and therefore are slow to respond. Further, sensors used to identify valve member position, which is determinative of exhaust gas flow, are relatively inaccurate and are susceptible to losing their accuracy. Consequently, mixing exhaust gas with intake air is conventionally done on a very conservative basis. Encircled area 18, while not exact, is exemplary, of where on the % maximum torque versus RPM curve, exhaust gas is currently utilized in standard engine designs. Encircled area 17 indicates the approximate region where the introduction of exhaust gas into intake air theoretically can benefit engine performance. Encircled area 19 illustrates the region where the current invention, with enhanced EGR valve feedback control response and improved sensing of valve member position, and hence, improved determination of the exhaust gas quantity to be added to intake air, will ideally operate. The present invention thus provides for improved gas mileage and pollution control through more accurate exhaust gas metering which allows an engine to operate closer to theoretical limits of performance. The components which allow for this improved EGR system are described below.

Figure 3:
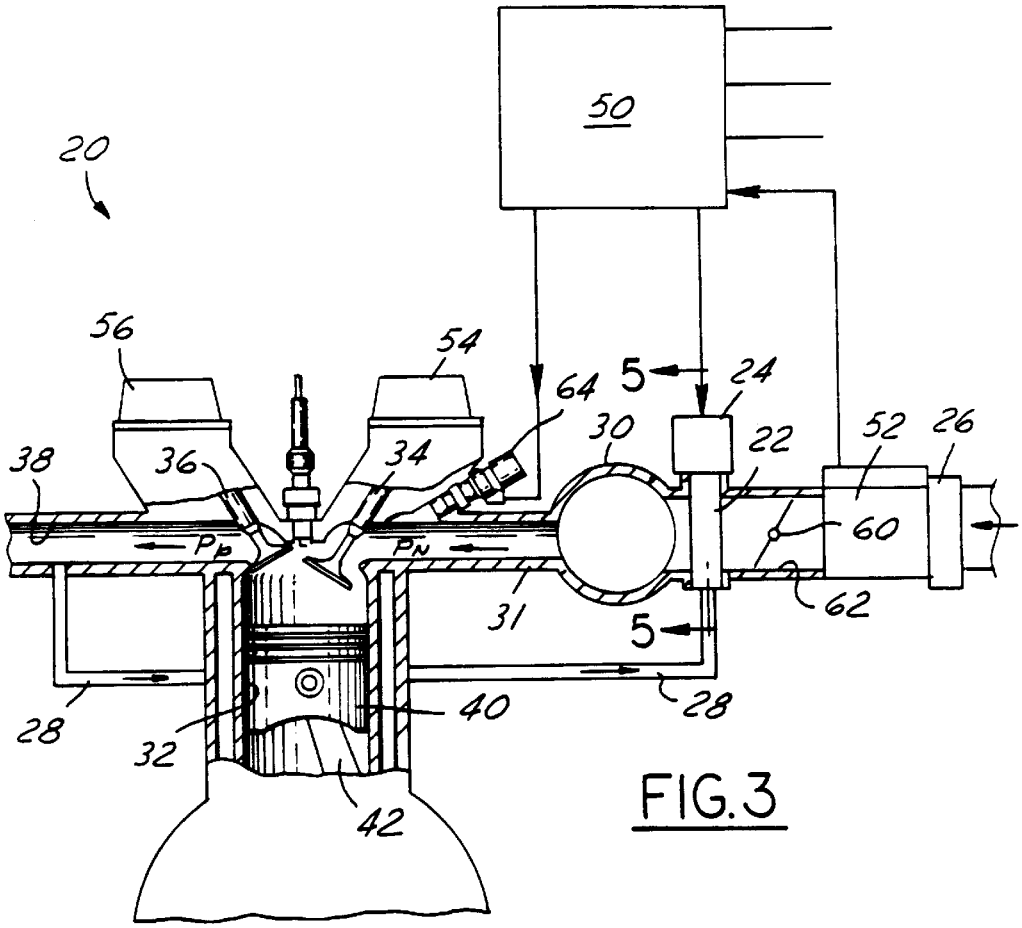
FIG. 3 is a schematic view, partially cut away, of an exhaust gas recirculation system including a pressure balanced solenoid actuated exhaust gas recirculation (EGR) valve mechanism and a fluid mixing housing, made in accordance with the present invention.

FIG. 3 shows a portion of an internal combustion engine 20. Engine 20 includes a fluid mixing housing 22 on which an EGR valve mechanism 24 is mounted, both of which are made in accordance with the present invention. Mixing housing 22 receives fresh air from an air cleaner 26 and exhaust gas from an exhaust gas recirculation tube 28. The air and exhaust gas are mixed in mixing housing 22 and the exhaust gas/air mixture is introduced into a collector 30 of engine 20. An intake manifold 31 comprises mixing housing 22 and collector 30.

Collector 30 fluidly connects with one or more engine cylinders 32 (one shown) which serve as combustion chambers. A piston 40 and connecting rod 42 are disposed in each of the cylinders 32. Power is transferred to a crankshaft (not shown) by piston 40 and connecting rod 42 when a fuel/air/exhaust gas mixture is burned in cylinder 32. Intake valve 34 and exhaust valve 36 control the flow of gas into and out of cylinder 32. Exhaust gas exiting cylinder 32 passes into an exhaust manifold 38. Conduit or tube 28 feeds a portion of the exhaust gas from exhaust manifold 38 to mixing housing 22.

Piston 40 draws in the exhaust gas/air mixture during an intake stroke creating a negative pressure $P_N$ in the intake manifold 31 relative to the ambient atmospheric air pressure. A positive pressure $P_P$, relative to ambient atmospheric air, is established in exhaust manifold 38 due to the exhaust gas being forced from cylinder 32 during an exhaust stroke. Accordingly, exhaust gas readily passes from exhaust manifold 38 through tube 28 to mixing housing 22 which is in fluid communication with intake manifold 31.

Other components of engine 20 include an engine controller 50, a mass air-flow sensor 52, air cleaner 26, and intake and exhaust valve actuators 54 and 56, respectively, which control intake and exhaust valves 34 and 36. Also, a throttle 60 for controlling air input is disposed in an air intake passageway 62 positioned between sensor 52 and mixing housing 22. A fuel injector mechanism 64 controls the flow of fuel into cylinder 32. Engine controller 50 receives input data such as engine speed, manifold pressure, temperature, and mass flow and dispatches signals which control the operation of EGR valve mechanism 24, throttle 60 and fuel injector mechanism 64, as well as other engine components.

Figure 4:
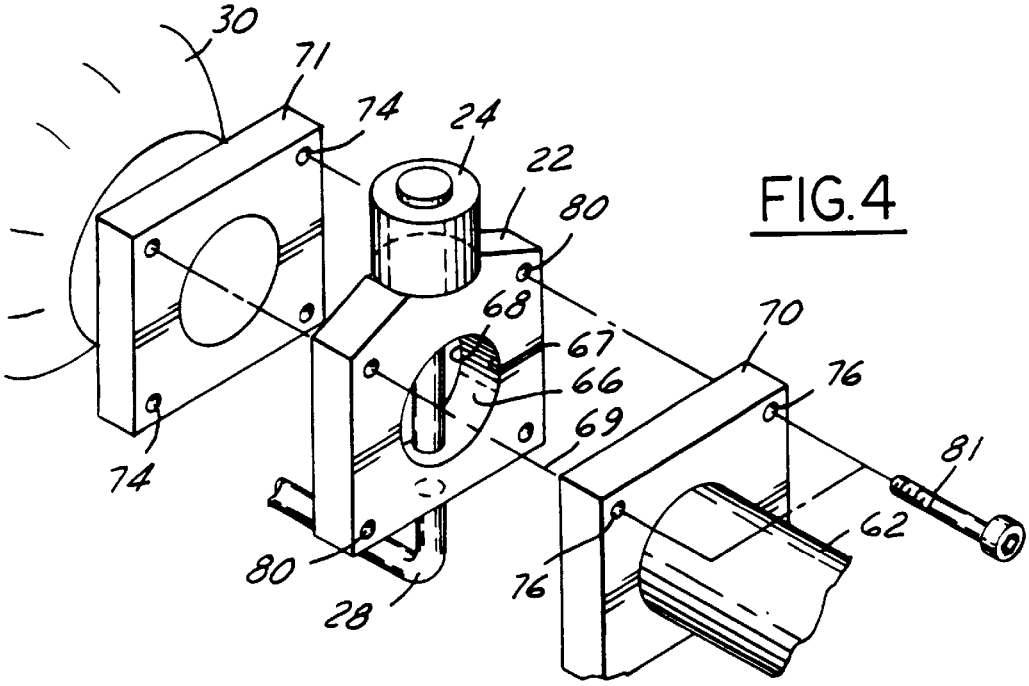
FIG. 4 is an exploded perspective view of the preferred fluid mixing housing with an EGR valve mechanism mounted thereon in fluid communication with an air intake passageway and a collector.

FIG. 4 illustrates the combination of the fluid mixing housing 22, air intake passageway 62 and collector 30, as well as the connection arrangement between them. Fluid mixing housing 22 has a central bore or passageway 66 therein with an upstream inlet 67 and a downstream outlet 68. Bore 66 extends along a longitudinal axis 69. The air intake passageway 62 and collector 30 are fastened to housing 22 by mounting plates 70 and 71, respectively. Mounting plate 71 has threaded holes 74, while mounting plate 70 and fluid mixing housing 22 have through holes 76 and 80, respectively. Four bolts 81 (only one of which is shown) pass through holes 76 and 80 and are threadedly received in threaded holes 74. In this manner, housing 22 is securely held in position between air passageway 62 and collector 30.

EGR tube 28 is also connected to housing 22, as described in more detail below. EGR tube 28 extends upwardly through passageway/bore 66 transverse to axis 69 and is held in position by the two halves of mixing housing 22.

Figure 5:
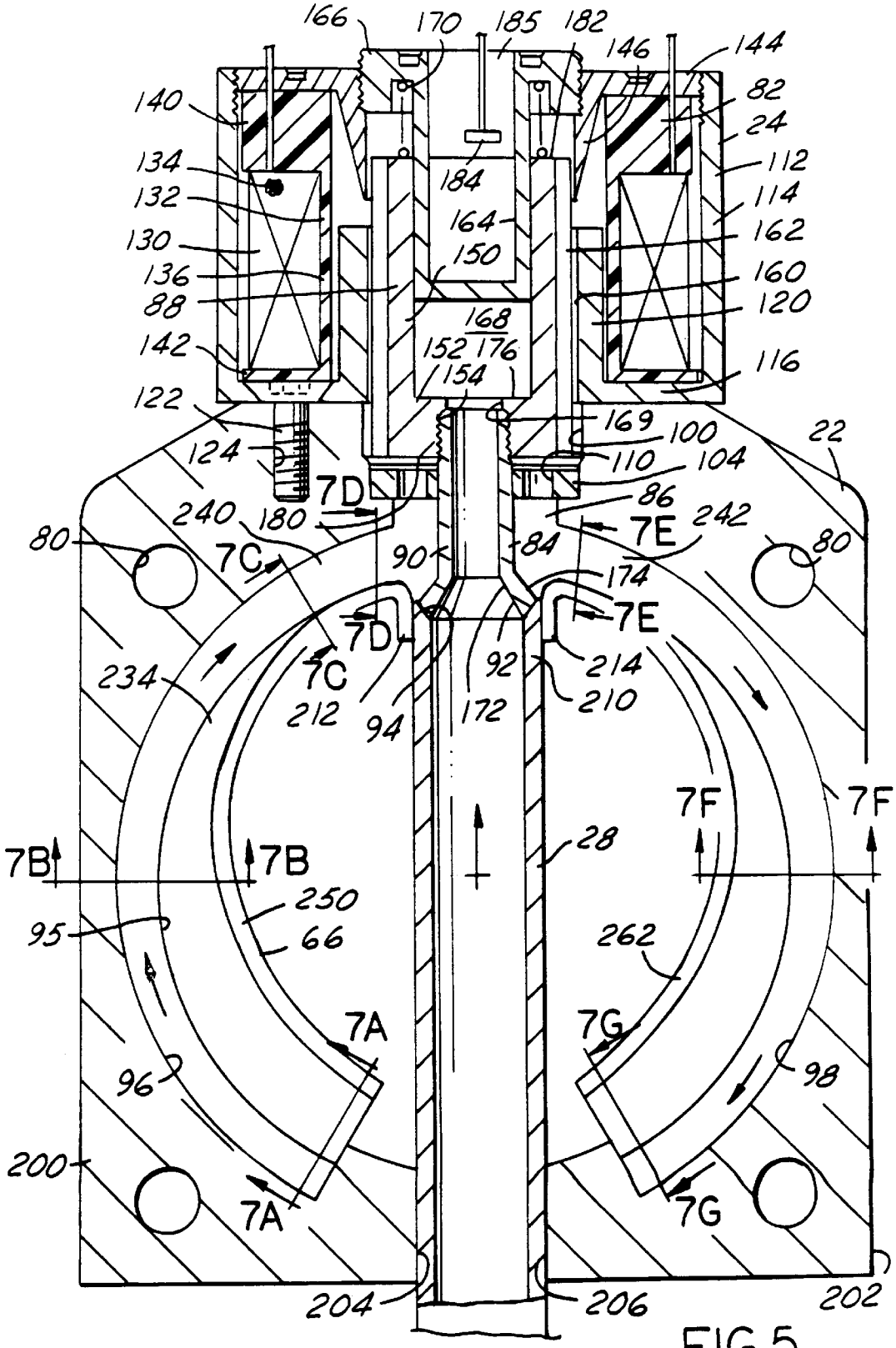
FIG. 5 is a cross-sectional view taken generally along line 5—5 of FIG. 3.

A cross-sectional view through housing 22, EGR valve mechanism 24 and tube 28 is shown in FIG. 5. Mixing housing 22 is preferably made of a non-magnetic material, preferably plastic, although other non-metallic materials such as aluminum may also be used. Valve mechanism 24 includes a solenoid assembly 82 which is securely fastened to housing 22. Valve mechanism 24 operates a moveable valve member 84 to control the exhaust gas flow from tube 28 into a mixing chamber 86 in mixing housing 22.

Figure 6:
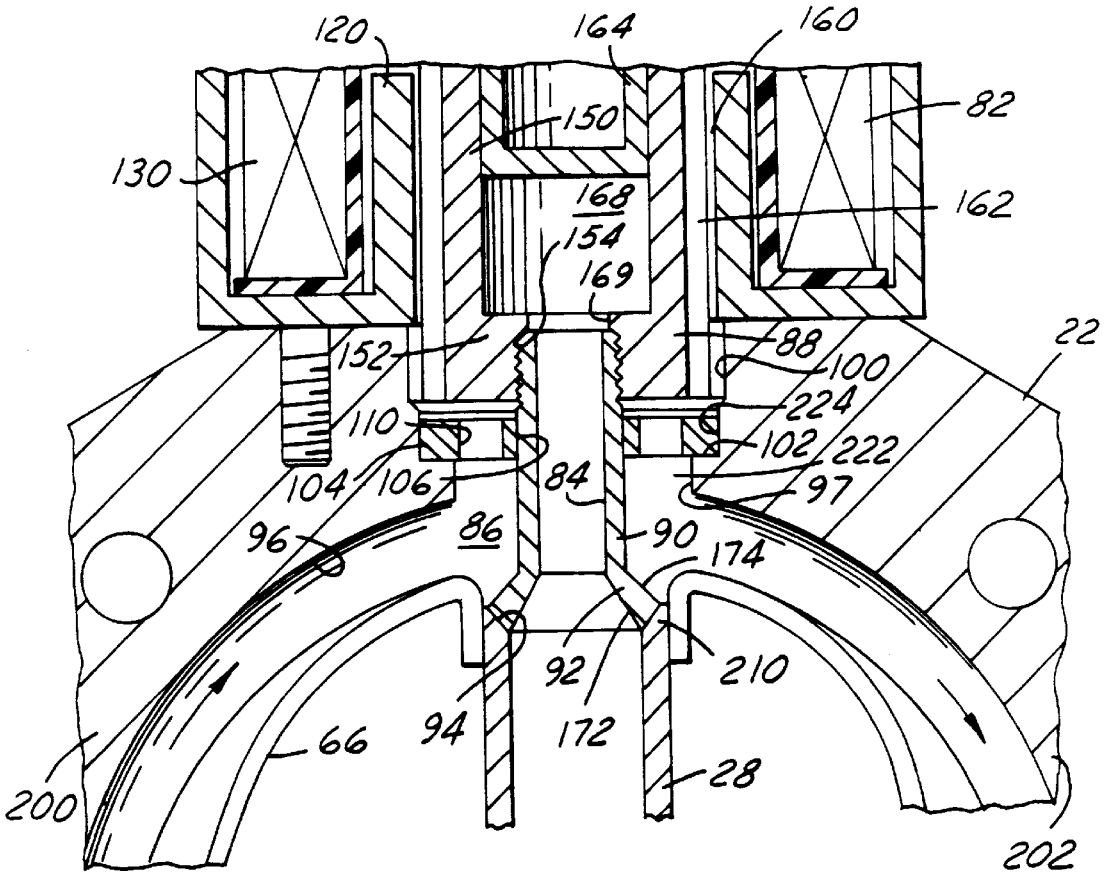
FIG. 6 is an enlarged view of a portion of FIG. 5.

FIG. 6 shows an enlarged cutaway of the solenoid assembly 82, valve member 84 and housing 22. An armature 88 of the solenoid assembly 82 is attached to valve member 84. Valve member 84 has a stem member 90 and a frustoconical or funnel shaped valve head 92. Valve head 92 selectively opens and closes relative to a valve seat 94 formed on the end of tube 28 to open and close communication between EGR tube 28 and mixing chamber 86. The mating configuration between valve head 92 and valve seat 94 is selected to produce a flow profile, such as a linear or parabolic profile, as is well known in valve design.

Referring to FIG. 5, most of the air from air cleaner 26 passes through central bore 66 in housing 22. However, in accordance with the present invention, a portion of the incoming air is directed through a substantially arcuate channel or passageway 95. Passageway 95 has an upstream opening inlet channel 96 and a downstream opening outlet channel 98. A portion of the air flow through housing 22 is captured by inlet channel 96 and passes circumferentially through mixing chamber 86 where it is mixed with exhaust gas from EGR tube 28. The exhaust gas/air mixture then passes from mixing chamber 86 to outlet channel 98 where the mixture is rejoined with the main air flow traveling through central bore 66.

The preferred mixing housing for use with the solenoid activated valve mechanism, particularly when used in an EGR system, is more compact in size than conventional intake air-exhaust gas mixing apparatus and more homogeneously mixes the two fluids. The fluid mixing housing has an inlet channel ideally of diminishing cross-sectional size which intercepts a portion of a first fluid flow and directs it to a mixing chamber. The mixing chamber also receives a second fluid, such as exhaust gas, and is connected to an outlet channel of preferably increasing cross-sectional size. The outlet channel returns the portion of the first flow, which is now homogeneously mixed with the second fluid flow, to the first fluid flow. The first fluid flow induces these mixed fluids to be drawn out of the outlet channel. A venturi effect is created in the mixing chamber which increases the pressure drop from an exhaust gas manifold to the mixing chamber and which enhances gas flow in the system without having to increase the size of a conduit carrying exhaust from the exhaust manifold to the intake manifold.

The disclosed mixing housing, when used as part of an EGR valve mechanism, reduces contamination build-up along the valve seat due to the passing airstream of increased velocity which keeps the exhaust gas particles in suspension and flushes away settled particles. This air stream also acts to cool down the valve member and thereby reduce temperature migration into other portions of the valve mechanism, such as the solenoid. The housing further utilizes venturi effects to create an additional pressure drop in the mixing housing to enhance fluid flow through the mixing mechanism.

Fluid mixing housing 22 includes a counterbore 100 which forms an internal shoulder 102. The solenoid assembly 82 is positioned in bore 100. A bearing plate 104 is seated with a press fit connection into bore 100 and guides the reciprocation of stem member 90 by means of a guide bore 106. Bearing plate 104 also has access holes 110 which permit fluid communication between mixing chamber 86 and solenoid assembly 82. Mixing chamber 86 is defined generally as the space between bearing plate 104 and EGR tube 28 in housing 22.

Solenoid assembly 82 further comprises an annular shaped housing 112 of magnetic steel or the like which has an outer wall 114, an annular bottom wall 116 and an inner wall 120. Bottom wall 116 of housing 112 is attached to mixing housing 22 by fasteners 122 (one shown) which are received in tapped holes 124 in mixing housing 22.

Solenoid assembly 82 further includes a coil 130 which comprises a spool 132 of suitable plastic and a wire 134 of copper or other suitable electrically conductive material. Wire 134 is wound on a hollow shaft 136 of spool 132 between two end plates 140 and 142. Spool 132 fits radially between outer wall 114 and inner wall 120 of housing 112. Inner wall 120 extends preferably about one-half the length of hollow shaft 136.

Solenoid assembly 82 has an annular cover 144 which is screwed into the open upper end of the housing 112. Annular cover 144 has a depending annular flange 146 which is concentrically arranged with respect to inner wall 120 of housing 112. Flange 146 extends part way into the spool 132. Cover 144 is made of a magnetic material such as soft iron or the like so that cover 144 and housing 112 act as a pole piece. When cover 144 is attached to housing 112, the lower end of depending flange 146 is positioned adjacent the upper end of armature 88 and spaced from the upper end of the inner wall 120 so that armature 88 is drawn up into the pole piece when coil 130 is energized.

Armature 88 is made of a magnetic material and is disposed inside coil 130 and within inner wall 120. Armature 88 has a hollow cylindrical body 150 and a bottom wall 152 which has a threaded bore 154. Hollow valve member 84 has an upper end which is attached to armature 88 and a flared lower end forming valve head 92. Valve member 84 may be attached in any suitable manner to armature 88, such as by being threaded into a threaded bore, as shown in FIGS. 5 and 6. The flared valve head 92 is positioned and adapted to engage valve seat 94 to produce the desired flow profile when valve member 84 is opened.

The inner diameters of inner wall 120 and depending flange 146 are substantially identical and larger than the outer diameter of armature 88 to provide an annular air gap 160 therebetween. Air gap 160 allows equalization of pressure inside solenoid assembly 82 and mixing chamber 86 via access holes 110. This pressure equalization is enhanced by providing a plurality of longitudinal grooves 162 around the perimeter of the outer surface of cylindrical body 150 of armature 88.

Solenoid assembly 82 further includes a hollow stem 164 that depends from a threaded cap 166 which is screwed into annular cover 144. The lower end of the hollow stem 164 is closed and is situated inside the upper end of hollow armature 88 with a close sliding fit existing therebetween. In this manner, hollow armature 88 reciprocates on the stem 164 and forms an expandable mechanism that includes a sealed chamber 168 which is fluidly connected with mixing chamber 86 by way of an orifice 169 in bottom wall 152 which in turn communicates with hollow valve member 84. This allows balancing forces created by the exhaust gas to act on the moving combination of valve member 84 and armature 88 as will be described in greater detail below.

Solenoid assembly 82 also includes a return spring in the form of a coil spring 170 which surrounds stem 164. Spring 170 engages the top of armature 88 and acts to force armature 88 downwardly away from threaded cap 166 and toward housing 22.

Engine controller 50 controls the current which is fed to coil 130 of solenoid assembly 82 in a programmed manner so that armature 88 reciprocates upon hollow stem 164 and moves valve head 92 of valve member 84 toward and away from valve seat 94. When energized, coil 130 pulls armature 88 vertically with respect to the coil 130 against the force of coil spring 170 and thus pulls valve member 84 away from valve seat 94. This establishes fluid communication between EGR tube 28 and mixing chamber 86 so that the exhaust gas can flow into mixing chamber 86 and mix with the air in chamber 86.

When coil 130 is deenergized, valve head 92 of valve member 84 is seated against valve seat 94 by coil spring 170 thus blocking the flow of the exhaust gas past the valve seat 94. In this closed position, the exhaust gas cannot flow into mixing chamber 86. However, the exhaust gas communicates with sealed chamber 168 of the expandable mechanism via the hollow valve member 84 to pressure balance valve member 84 and armature 88 in the closed position.

Figure 10A:
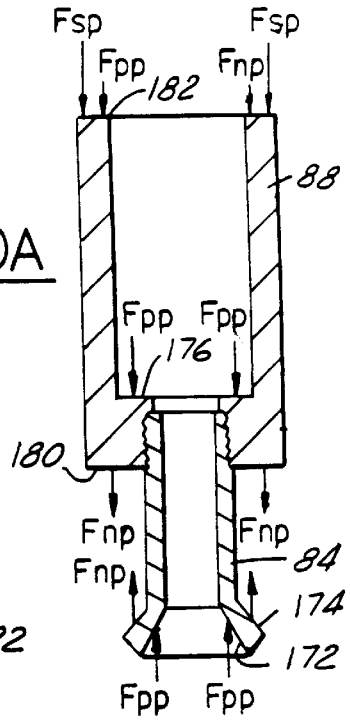
FIGS. 10A–C are free-body diagrams of balancing forces acting on the valve members and armatures of the respective valve mechanisms shown in FIGS. 5, 8 and 9, respectively.

As seen in FIGS. 5 and 10A, the combination of valve member 84 and armature 88 has numerous annular surfaces which are pressure responsive to vertically applied pressure induced forces. These annular surfaces include inside and outside funnel surfaces 172 and 174, interior armature surface 176, bottom armature surface 180 and top armature surface 182.

In the closed position, the exhaust gas pressure acting against annular surface 176 creates a downward closing force while the exhaust gas pressure acting against the inner surface 172 of valve head 92 creates an upward opening force. A precise pressure balance can be achieved by sizing the horizontal projected areas of surfaces 172 and 176 to produce upward and downward forces that are equal and opposite to each other. Alternatively, it may be desired to slightly pressure bias valve member 84 and armature 88 to a closed position in the event return spring 170 were to break.

This pressure balancing allows use of a lighter coil spring 170 because the spring does not need to counteract exhaust gas pressure induced forces tending to open valve member 84. The lighter coil spring 170, in turn, reduces the electromotive force which must be produced by solenoid assembly 82 to move armature 88 and open valve member 84 against the force of spring 170. Since the electromotive force requirement is reduced, a smaller and lighter solenoid assembly can be used. Furthermore, a lower operating current to energize coil 134 can be employed.

Valve member 84 is also preferably pressure balanced on the vacuum side in either the closed or open positions. In a closed position, a negative pressure, relative to ambient air pressure, is found in mixing chamber 86. The negative pressure acts on outer surface 174 of valve head 92 and produces an upward valve opening force. However, mixing chamber 86 and the exterior of armature 88 are also at substantially the same negative pressure due to access holes 110 in bearing plate 104 which establish communication between armature 88 and mixing chamber 86. Thus the negative pressure acting on the bottom annular surface 180 of armature 88 produces a valve closing force. At the same time the vacuum pressure in solenoid assembly 82 acting on top annular surface 182 of armature 88 produces a valve opening force. A precise negative pressure balance can be achieved by sizing the areas of surfaces 174, 180 and 182 to produce a relatively balanced valve closing force.

FIG. 10A more clearly shows the forces which act to move valve member 84 and armature 88 between the open and closed positions. Resultant forces acting on projected horizontal surfaces due to positive relative pressure are identified by $F_{PP}$ (force positive pressure). Similarly, relative negative forces pulling on projected horizontal surfaces are designated with $F_{NP}$ (force negative pressure). The positive force $F_{PP}$ acting on annular surface 172 balances the positive force $F_{PP}$ acting on annular surface 176. Independently, negative forces $F_{NP}$ acting on surfaces 174 and 182 balance the downward force $F_{NP}$ on annular surface 180. Regardless of the magnitudes of the negative or positive pressures, armature 88 and valve member 84 will not be induced to open or close the valve. The small spring force $F_{SP}$ exerted downwardly by spring 170 on annular surface 182 is sufficient to keep the valve member 84 closed. Again, only a small electromotive force is needed to overcome spring force $F_{SP}$ to unseat valve member 84 from valve seat 94.

In this regard, if the positive pressure exhaust gas and negative pressure vacuum from mixing chamber 86 are both precisely balanced on valve member 84 and armature 88, spring 170 only needs to be sufficiently strong to keep valve member 84 closed against vibrations encountered during operation of the vehicle in which the valve mechanism 24 is installed. With such a spring, the size and weight of solenoid assembly 82 and/or the operating current requirements can be substantially reduced.

Valve mechanism 24 also preferably includes a non-contact type field sensor 184, such as a Hall effect sensor, shown in FIG. 5, to monitor the position of the armature 88 and valve member 84. Field sensor 184, which is housed in the upper end of threaded cap 166 by a plastic plug 185 or the like detects the magnetic flux density induced by solenoid coil 130 which changes with the movement of the armature 88 and determines the precise position of the armature 88 and valve member 84. This precise position measurement is used to accurately control the stroke of armature 88 and the opening between the valve member 84 and valve seat 94. Hence, the present invention can be used to combine exhaust gas with fresh air flowing through mixing chamber 86 and introduce the gas mixture to the intake manifold 31 with greater precision than conventional EGR valves. This in turn results in emission reductions and increased fuel efficiency. Another advantage of the use of the Hall effect field sensor 184 is that the sensor can be easily packaged inside the solenoid assembly 82 to provide a compact, lightweight integral unit. The calibration of field sensor 184 will be described later with respect to FIGS. 12 and 13.

Referring again to FIG. 5, the details and features of a preferred mixing housing 22 will now be discussed. Housing 22 includes first and second half members 200, 202 which are preferably made of a molded plastic, such as a glass reinforced nylon. However, other materials such as aluminum may also be used. This choice is partially dependent upon EGR gas temperature. Further, housing 22 may be split in other directions rather than laterally as shown.

As described above, first and second half members 200, 202 are provided with holes 80 for receiving bolts 82. An end portion of EGR tube 28 extends into mixing housing 22 and cooperates with EGR valve mechanism 24 to selectively control the input of exhaust gas into mixing housing 22. First and second half members 200, 202 have respective grooves 204 and 206 which clamp about tube 28 at the point where tube 28 enters housing 22. A terminal end portion 210 of the tube 28 is clamped by arcuate seal portions 212, 214 of first and second half members 200, 202. Also, arcuate cavities 222 and 224 are formed in housing 22 which define counterbore 100, counterbore 97, and mixing chamber 86.

Inlet channel 96 and outlet channel 98 are formed in respective first and second half members 200 and 202. The cross-sectional sizes and shapes of channels 96 and 98 along their lengths are shown in FIGS. 7A–G. Inlet channel 96 has a circumferentially extending open segment 234 (FIG. 5) with inlet opening 235 (FIG. 7A) which opens generally upstream into the axial flow of the fresh air from air intake passageway 62. In contrast, outlet channel 98 has a circumferentially extending outlet segment 236 (FIG. 5) with outlet opening 237 (FIG. 7G) which opens downstream in the direction of air flow toward intake valve 34. As shown in FIGS. 5, 7C, 7D and 7E, the inlet and outlet channels 96 and 98 also have respective closed segments 240 and 242 near mixing chamber 86.

Viewing housing 22 in FIG. 5 as a clock face, and taking into account the cross-sections as shown in FIGS. 7A–G, open segments 234 and 236 extend clockwise approximately between the 7:30 and 11:30 positions and the 12:30 and 4:30 positions, respectively. Closed segments 240 and 242, together with mixing chamber 86, extend circumferentially between the 11:30 and 12:30 positions.

As an overview, a portion of the air flow from air passageway 66 is intercepted by inlet channel 96 and circumferentially funnelled clockwise to outlet channel 98 where the intercepted air is reunited with the main air flow travelling through main bore 66 to collector 30. Exhaust gas from EGR tube 28 is introduced into mixing chamber 86 and mixed with the air captured by inlet channel 96. The mixture of exhaust gas and air is then discharged through outlet channel 98. Thus, arcuate channel 95 which includes inlet channel 96, mixing chamber 86 and outlet channel 98, serves as a generally arcuate mixing bypass in housing 22.

As explained above, cross-sectional views through inlet and outlet channels 96 and 98 are shown in FIGS. 7A–G. Inlet channel 96 is defined by an inlet flap 250, a downstream portion 252, an outer wall portion 254 and an upstream portion 256 (see FIG. 7A). Inlet flap 250 extends axially upstream and radially inwardly from downstream portion 252. Upstream portion 256 also includes a tapered wall 257 which extends radially inwardly. Inlet opening 235 is formed between inlet flap 250 and upstream portion 256.

Figure 7A:
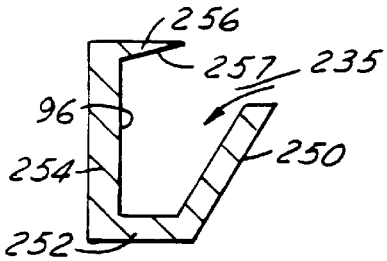
FIGS. 7A–G are cross-sectional views taken from the fluid mixing housing as indicated by lines 7A—7A, 7B—7B, 7C—7C, 7D—7D, 7E—7E, 7F—7F and 7G—7G, respectively, in FIG. 5.
Figure 7B:
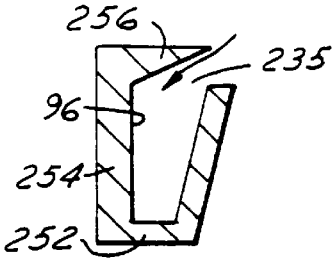
Figure 7C:
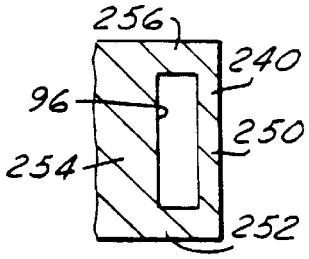
Figure 7D:
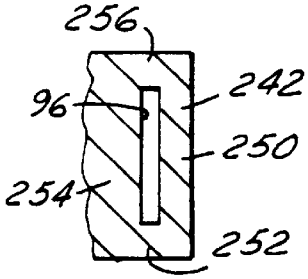
Figure 7E:
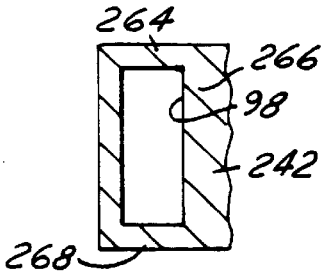
Figure 7F:
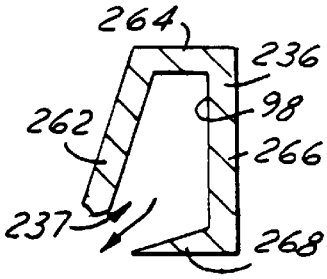
Figure 7G:
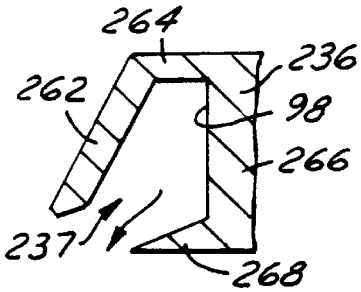

Outlet channel 98 has an outlet flap 262, an upstream portion 264, an outer wall portion 266 and a downstream portion 268 (see FIG. 7G). Outlet flap 262 extends axially downstream and radially inwardly from upstream portion 264, and upstream portion 264 and downstream portion 268 extend radially inwardly from outer wall portion 266 and define outlet opening 237 therebetween.

Both inlet and outlet channels 96 and 98 vary in cross-section along their circumferential lengths. In FIG. 7A, inlet opening 235 has a maximum cross-sectional area. As shown in FIGS. 7A and 7B, inlet opening 235 decreases in size as inlet channel 96 extends circumferentially clockwise toward mixing chamber 86. The cross-sectional area bounded by inlet channel 96 also decreases as inlet channel 96 extends circumferentially clockwise.

At approximately the 11:30 position and as shown in FIG. 7C, inlet flap 250 connects with upstream portion 256 such that inlet channel 96 becoming a closed rather than open channel thus defining the transition between open and closed segments 234 and 240. Note that the cross-sectional size of inlet channel 96 is substantially smaller than that of outlet channel 98 directly adjacent mixing chamber 86 (as shown by a comparison of FIGS. 7D and 7E). Also, inlet channel 96 narrows in cross-section from its beginning to end, as indicated in FIGS. 7B, 7C and 7D.

Mixing chamber 86 connects closed segment 240 of inlet channel 96 with closed segment 242 of outlet channel 98. Ideally, the minimal cross-sectional flow area in mixing chamber 86, with valve member 84 present, is less than that of inlet channel 96 at section 7D—7D. Closed segment 242 of outlet channel 98 is shown in FIG. 7E at approximately the 12:30 position. As outlet channel 98 continues clockwise, outlet flap 262 extends increasingly radially inwardly thereby increasing the size of outlet opening 237, as sequentially shown in FIGS. 7E–7G. Also, the area bounded by outlet channel 98 increases as outlet channel 98 extends circumferentially clockwise.

In operation, air flows downstream from air passageway 62 through housing 22 and to collector 30. A portion of the air flow is captured by inlet flap 250 which funnels the captured air circumferentially clockwise through inlet channel 96. As the cross-sectional size of inlet channel 96 decreases in the clockwise direction, the pressure decreases and velocity of the captured air increases at closed segment 240 adjacent mixing chamber 86. With the valve member in the open position, the cross-sectional area of the mixing chamber is smaller than the cross-sectional area of the adjacent inlet channel. Thus, air velocity is at a maximum as it passes through the mixing chamber 86. Accordingly, with the valve member 84 open, the high speed of the captured air passing across tube 28 in mixing chamber 86 creates a first venturi effect which causes exhaust gas to be drawn into mixing chamber 86.

The mixture of exhaust gas and captured air exits the mixing chamber 86 into closed segment 242 of outlet channel 98. The exhaust gas/air mixture travels to open segment 236 and escapes downstream through outlet opening 237. As outlet channel 98 opens and increases in size circumferentially clockwise, the mixture of exhaust gas and captured air decreases in velocity. The fast flow of the main air stream passing through central bore 66 of housing 22 across outlet opening 237 creates a second venturi effect which draws the exhaust gas/air mixture from mixing chamber 86 through outlet channel 98 and back into the main air flow passing into collector 30. The interaction between the air and exhaust gas results in the exhaust gas being thoroughly mixed with the intake air and the particulates in the exhaust gas swirling and remaining in fluid suspension.

The above arrangement and use of mixing housing 22 has numerous advantages over conventional EGR and other fluid mixing systems. First, housing 22 is compact and lightweight and effectively mixes two separate fluids, e.g. exhaust gas and air, in a compact area. Second, when valve mechanism 24 is open, the low pressure in mixing chamber 86 draws the two fluids into mixing chamber 86 and increases the exhaust gas fluid flow through mixing housing 22 as compared to the exhaust gas flow due only to the pressure of the exhaust gas. Further, contamination buildup in valve seat 94 of valve member 84 and bearing plate 104 is reduced due to the high velocity cleansing air stream passing circumferentially therealong. Finally, high velocity fluid flow through mixing housing 22 cools down valve member 84 and associated stem member 90 which reduces heat transfer into solenoid assembly 82.

Figure 12A:
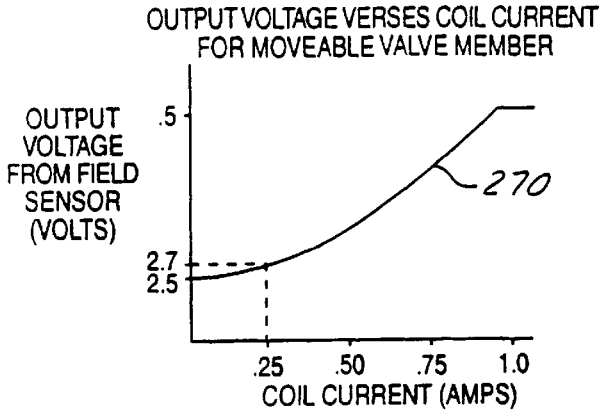
FIGS. 12A–E are graphs indicative of steps used in calibrating a field sensor used in the inventive valve mechanisms.

The graphs in FIGS. 12A–E relate to the calibration process of the field sensor 184. Field sensor 184 in the preferred embodiment is a ratiometric linear Hall effect sensor such as models 3506, 3507 or 3508 sold under the trademark Allegro by MicroSystems, Inc. of Worcester, Mass. Alternatively, a GMR (Giant Magneto Resistive) sensor can be used such as Model NVS5B100 available from Non-Volatile Electronics, Inc. of Eden Prairie, Minn. As seen in FIG. 12A, field sensor 184 produces an output voltage of one-half the input voltage to field sensor 184 in the absence of any magnetic flux, which in this exemplary case, is 2.5 volts for a 5 volt input.

Curve 270 of FIG. 12A represents the output voltage from field sensor 184 due to magnetic flux produced as a result of current flowing through coil 130. At approximately 0.25 amperes, valve member 84 begins to open overcoming the bias of spring 170. As the current through coil 130 increases and as armature 88 moves closer to field sensor 184, the strength of the magnetic flux field about field sensor 184 increases and accordingly so does the output voltage produced by field sensor 184.

Figure 12B:
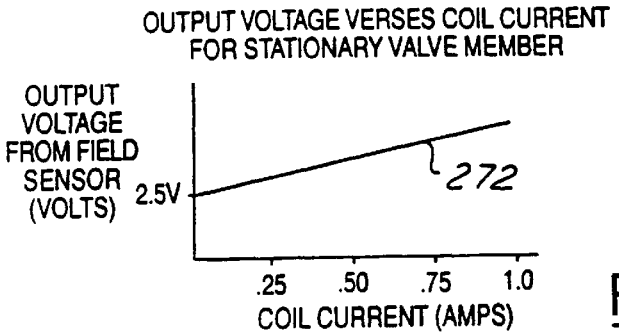
Figure 12C:
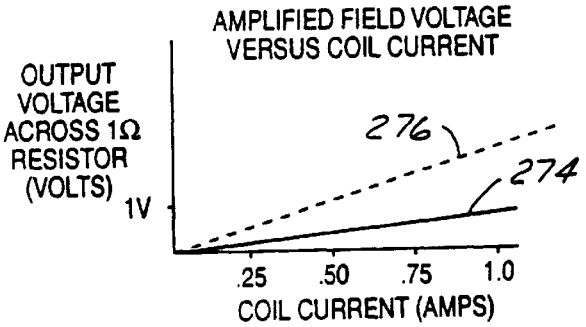

It is foreseeable that valve member 84 and armature 88 might become stuck closed or open despite current flowing through coil 130. FIG. 12B depicts the output voltage, curve 272, from field sensor 184 due to current flowing through coil 130 over the normal operating current range while valve member 84 is held in a closed position. It is desired that an output voltage will be produced and sent to the engine controller 50 which is indicative of the position valve member 84 and is not dependent upon the current flowing through coil 130.

Figure 12D:
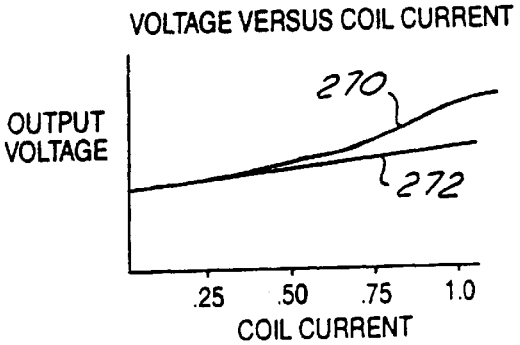
Figure 12E:
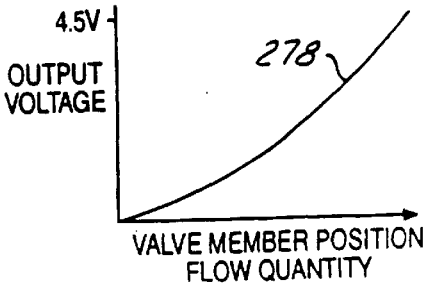

In an effort to nullify the effect of current flowing through coil 130 on the magnetic flux field near field sensor 184, this coil current induced voltage output, curve 272, is subtracted from the overall voltage output curve 270. Preferably, a 1.0 ohm resistor (not shown) is placed in series with coil 130. By evaluating the voltage across this resistor, the corresponding current through the resistor and coil 130 are determined. Curve 274 in FIG. 12C describes the resistor voltage versus coil current. This output voltage is then amplified, by an auxiliary control circuitry (shown in FIG. 13) to produce an output voltage versus current curve 276 having the identical slope to that of curve 272 in FIG. 12B. This voltage is then offset by 2.5 volts so that a voltage curve 272', depicted in FIG. 12D, is produced which is generally identical to curve 272 of FIG. 12B. The difference in voltage between curves 270 and 272' is then amplified by control circuit 280 to ideally give a 0–5 volt output over the operating current range of the solenoid assembly 82. This amplified voltage is then calibrated against displacement of valve member 84 using a LVDT (Linear Variable Displacement Transducer) to produce curve 278 of FIG. 12E. Alternatively, flow through valve assembly 24, at a static pressure, could be calibrated against this output voltage 278 using a flow meter.

Figure 13:
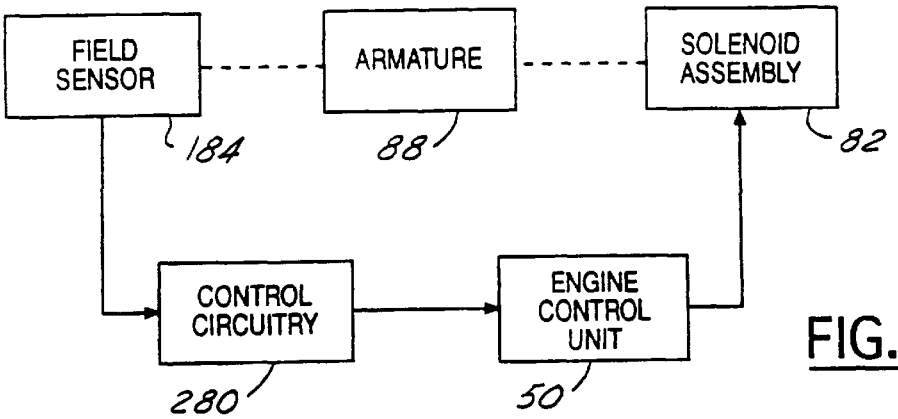
FIG. 13 is a block diagram of a feedback system used to control the position of a valve member.

Control circuitry 280, which is schematically shown in FIG. 13, is mounted on a circuit board (not shown) in the vehicle. The output voltage from field sensor 184 is fed to control circuitry 280. Likewise, the voltage from across the resistor is communicated to the control circuitry 280 where this voltage is amplified and offset, as depicted in FIG. 12D. The differences in these voltages is amplified, FIG. 12E, to produce a voltage output which is communicated to engine controller 50. This voltage is representative of the position of valve member 84. Vehicle engine controller 50 then controls the current in solenoid assembly 82 to control armature 88 and the admittance of exhaust gas into mixing housing 22. Conventional electronic elements are used along with laser trimming of resistors on the control circuitry 280 to calibrate control circuitry 280. This laser trimming and calibration occurs during the assembly of valve mechanism 24. Further, this calibration procedure accommodates errors due to, including, but not limited to, tolerancing of components such as housing 112, valve member 84, etc.

Figure 14:
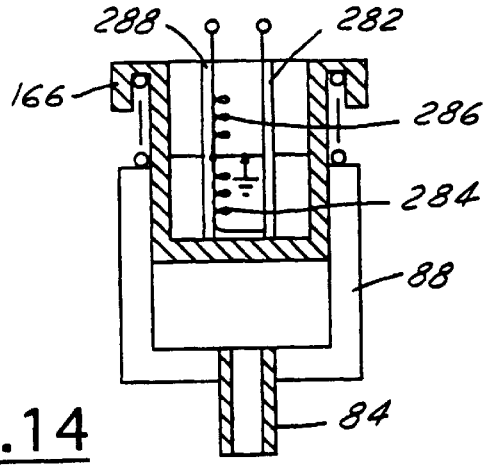
FIG. 14 is a schematic view including an inductance sensor which is used as a field sensor.

As an alternative to using a Hall effect field sensor, an induction type field sensor 282 may be used in place of field sensor 184. Inductance type position sensors are conventionally known. Referring to FIG. 14, inductance sensor 282 has first and second coils 284 and 286 mounted on a backing plate 288. Backing plate 288 is mounted within cap 166 in place of field sensor 184. The upper end of armature 88 is generally aligned with first coil 284 when valve member 84 is in a closed position. Since armature 88 is spaced away from second coil 286, little inductance is created in second coil 286. When coil 130 is energized, however, armature 88 and valve member 84 are moved toward cap 166 and field sensor 282. First coil 284 induces a current in armature 88 which, in turn, induces a current in second coil 286. The current, or frequency, in second coil 286 is indicative of the relative displacement of armature 88 from its closed position.

Conditioning circuitry is again used to condition the voltage output from inductance sensor 282 against either displacement or flow to produce a conditioned output voltage. This output voltage may be conditioned to match an engine manufacturer's voltage output versus valve member displacement or flow specification. Inductance sensor 282 and conditioning circuitry are then placed in communication with engine controller 50.

Figure 8:
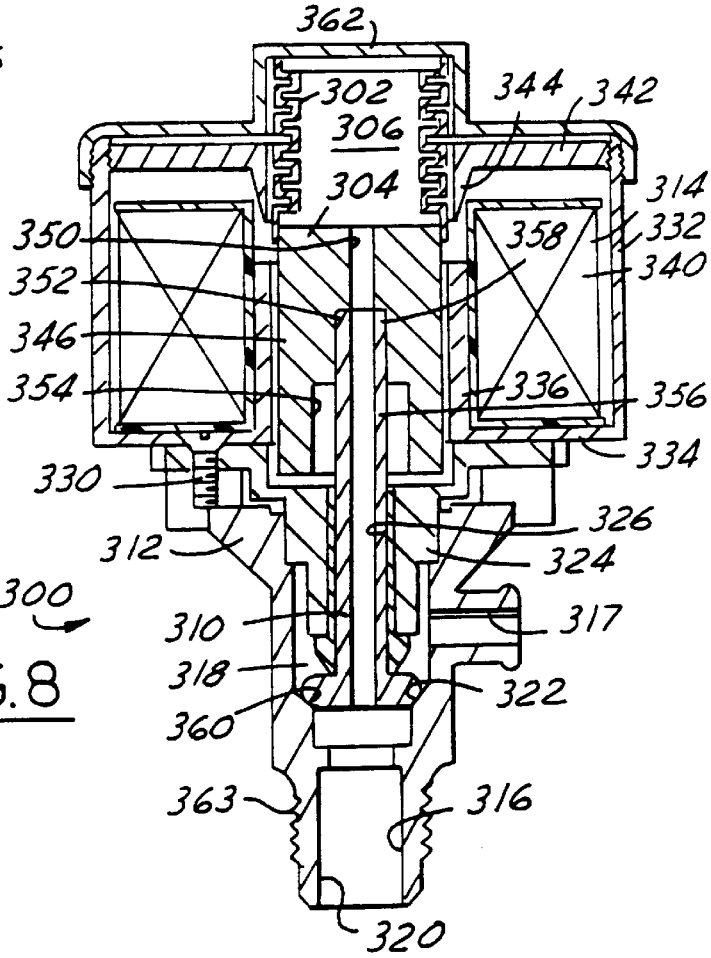
FIG. 8 is a cross-sectional view of a second embodiment of a pressure balanced solenoid actuated valve mechanism in accordance with the present invention.

FIG. 8 shows another embodiment of an exhaust gas recirculation valve mechanism 300 or fluid flow valve in accordance with the present invention. In this embodiment, a metallic bellows 302 is used to bias an armature 304 to a closed position. The metallic bellows 302 is also part of an "expandable" mechanism that includes an expandable sealed chamber 306 which is used to balance the exhaust gas pressure forces acting on armature 304 and a valve member 310.

More specifically, EGR valve mechanism 300 comprises a valve body 312 rather than utilizing fluid mixing housing 22 of the first embodiment. A solenoid assembly 314 is mounted on valve body 312 for operating the moveable valve member 310 and controlling the flow through valve body 312. However, it will be appreciated by those skilled in the art that solenoid assembly 314 could readily be adapted to work in conjunction with mixing housing 22.

Valve body 312 comprises an inlet passage 316 and outlet passage 317 which communicate with a central chamber 318 inside valve body 312. Inlet passage 316 includes an opening 320 and a valve seat 322. Valve member 310 engages valve seat 322 to block flow through inlet passage 316 into central chamber 318. Upon energizing solenoid assembly 314, valve member 310 is moved away from valve seat 322 to allow fluid to flow through opening 320 and into central chamber 318.

A bearing member 324 is seated in an enlarged upper portion of valve body 312. Bearing member 324 guides reciprocation of valve member 310 by means of a central bore 326. Central bore 326 has longitudinal grooves 328 to allow fluid communication between central chamber 318 and solenoid assembly 314. Central bore 326 has longitudinal grooves 328 to allow fluid communication between central chamber 318 and solenoid assembly 314. Bearing member 324 is clamped in place when solenoid assembly 314 is attached to valve body 312 by fasteners 330, only one of which is shown.

Solenoid assembly 314 comprises a cup shaped housing 332 which has an annular bottom wall 334 and an integral cylindrical inner wall 336 of circular shape. A coil 340 is disposed in housing 332. An annular cover 342 is screwed into the open upper end of housing 332. Annular cover 342 has a depending annular flange 344 which is concentrically arranged with inner wall 336. Depending flange 344 extends part way into the coil 340 and has an outer conical surface to facilitate assembly. Cover 342 is made of a magnetic material such as soft iron or the like so that cover 342 and depending flange 344 act as a pole piece.

Solenoid assembly 314 further comprises armature 304 made of a magnetic material and is disposed inside inner wall 336 of the housing 332. Armature 304 has a hollow cylindrical body 346 with a central bore 350 and two counterbores 352 and 354. Valve member 310 includes a hollow tube 356 which has a cylindrical upper end 358 and an enlarged valve head 360 at its lower end. The cylindrical upper end 358 is pressed into the inner counterbore 352 of armature 304 to securely attach valve member 310 to armature 304. The enlarged valve head 360 engages valve seat 322 to close valve mechanism 300.

Solenoid assembly 314 has an expandable mechanism which includes metallic bellows 302 which is disposed in housing 332 so that one end sealingly engages a threaded cap 362 which is screwed onto housing 332 over the annular cover 342. The lower end of the bellows 302 sealingly engages the upper end of the hollow armature 304. In this manner metallic bellows 302 forms an expandable sealed chamber 306 for the expandable mechanism which is fluidly connected with inlet passage 316 of valve body 312 via the bore of armature 304 and hollow valve member 310. Metallic bellows 302 also acts as a return spring which biases armature 304 away from cover 362 toward valve body 312.

Valve mechanism 300, as shown in FIG. 8, is incorporated into an exhaust gas recovery system of the type shown in FIG. 3 by connecting outlet passage 317 to collector 30 with valve body 312 replacing fluid mixing housing 22. Valve body 312 is threadedly attached to exhaust manifold 38 by way of an exhaust conduit (not shown). Threads 363 are formed on valve body 312 so that valve mechanism 300 may be attached to the exhaust conduit. When installed, solenoid assembly 314 is electrically connected to engine controller 50 in a manner similar to that illustrated schematically in FIG. 3.

Engine controller 50 controls the current fed to coil 340 of solenoid assembly 314 in a programmed manner so that the armature 304 reciprocates in the housing 332 moving valve member 310 toward and away from valve seat 322. When energized, coil 340 pulls armature 304 further up into coil 340 against the force of collapsing metallic bellows 302 which moves valve head 360 of valve member 310 away from valve seat 322. This establishes communication from inlet passage 316 to the central chamber 318 so that exhaust gases can flow through valve mechanism 300 and back into intake manifold 31.

When coil 340 is deenergized, valve head 360 of the hollow valve member 310 seats against valve seat 322 by the spring action of the expanding metallic bellows 302 thus blocking the flow of the exhaust gas past valve seat 322. In this closed position, the exhaust gas cannot flow into central chamber 318. However, the exhaust gas communicates with expandable chamber 306 inside metallic bellows 302 via the hollow valve member 310 and the bore of the armature 304 to pressure balance valve member 310 and armature 346 in the closed position.

Figure 10B:
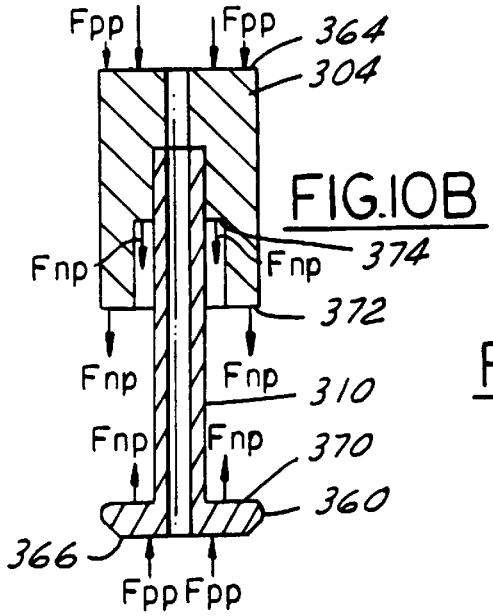

A free body diagram of armature 304 and valve member 310 is shown in FIG. 10B. In the closed position, exhaust gas pressure acting against an annular top surface 364 of armature 304 creates a downward closing force while the exhaust gas pressure acting against an annular surface 366 on the underside of valve head 360 creates an upward opening force. A precise pressure balance can be achieved by sizing the areas of surfaces 364 and 366 to produce a downward closing force $F_{PP}$ and an upward opening force $F_{PP}$ that are equal and opposite.

Valve member 310 is also preferably pressure balanced on the vacuum or negative pressure side. Vacuum or negative relative pressure "pulls" on upper annular surface 370 of valve head 360. In opposition, a downward force "pulls" on projected horizontal surfaces 372 and 374 of armature 304. By equating the total horizontal projected area of surfaces 372 and 374 with the projected area of surface 370, EGR valve mechanism 300 is generally pressure insensitive to changes in the relative negative pressure in intake manifold 31. Although not shown, it should be appreciated that position or field sensors as described elsewhere in this specification can also be used with this embodiment.

Pressure balancing in accordance with the present invention allows use of a light spring and a smaller and lighter solenoid assembly and/or a low operating current for solenoid assembly 314. Metallic bellows 302 not only provides an adequate spring force for closing the valve member 310, but forms part of the expandable mechanism which provides a pressure balance when the EGR valve mechanism 300 is closed.

Figure 9:
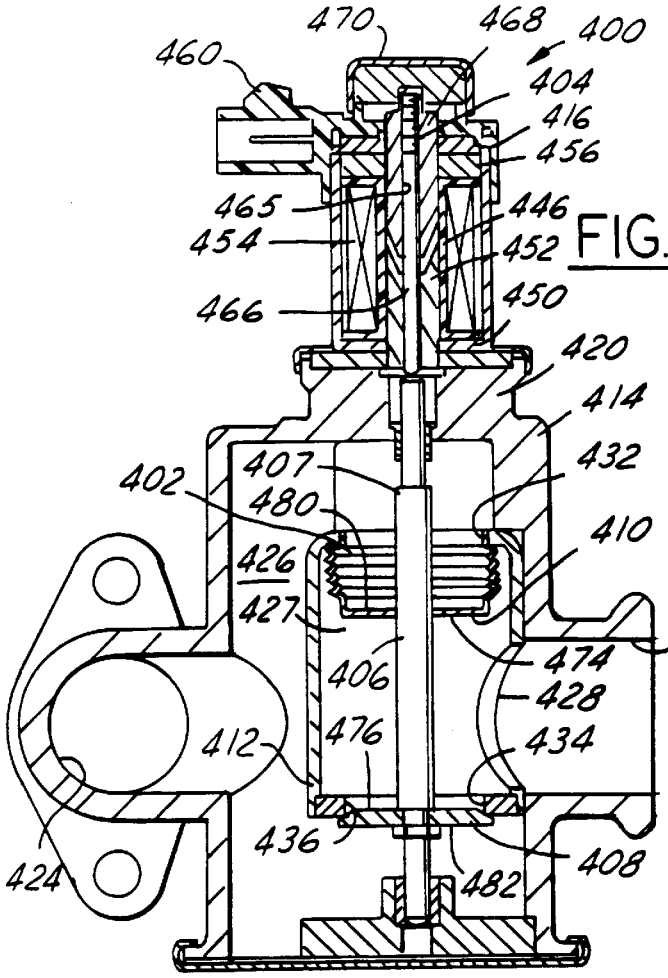
FIG. 9 is a cross-sectional view of a third embodiment of a pressure balanced solenoid actuated valve mechanism in accordance with the present invention.

FIG. 9 shows another embodiment of a fluid flow valve mechanism 400 in accordance with the present invention. Valve mechanism 400 includes a metallic bellow 402 which is used to bias an armature 404 to a closed position as well as provide part of an expandable mechanism which is used to balance a valve member 406. Valve member 406 has a stem 407 and a valve head 408. In this arrangement, metallic bellow 402 is sealed by an end plate 410 and is disposed in a casing 412 to provide an expandable mechanism which pressure balances valve member 406 in both the open and closed positions.

More specifically, the valve mechanism 400 comprises a self-contained valve assembly 414 and a solenoid assembly 416. Solenoid assembly 416 is attached to valve assembly 414 for operating moveable valve member 406 which is contained in a valve body 420 so as to control flow of exhaust gas through valve mechanism 400 when it is used as an EGR valve.

Valve body 420 comprises an inlet passage 422 and an outlet passage 424. A central chamber 426 is defined in valve body 420 outside casing 412. Casing 412 forms part of an expandable chamber 427. An opening 428 in casing 412 fluidly connects inlet passage 422 with expandable chamber 427. When valve member 406 is opened, exhaust gas can pass from inlet passage 422 through expandable chamber 427 to central chamber 426 and out outlet passage 424.

The opposite end walls of casing 412 have coaxially aligned openings 432, 434 and a valve seat 436. Valve head 408 engages valve seat 436 to block flow through the lower opening 434 in casing 412 to central chamber 424. Moving valve head 408 away from valve seat 436, that is, away from the position shown in FIG. 9, allows flow from inlet passage 422 through lower opening 434 in casing 412, into central chamber 424, and out of outlet passage 424.

Stem 407 of valve member 406 is solid and has its opposite ends slidably disposed in sleeve bearings supported in the opposite end walls of valve body 420 so that valve member 406 and stem 407 reciprocate in valve body 420 along the axis of the aligned openings in the end walls of the casing 412. The metallic bellow 402 is disposed in casing 412 and has an open upper end that is sealingly mounted in the upper opening 432 of casing 412. The lower end of the metallic bellow 402 is sealed by end plate 410 to form sealed expandable chamber 427 inside casing 412 which is in communication with inlet passage 422. End plate 410 is attached to stem 407 so that the bellow 402 holds valve member 406 in the closed position, as shown in FIG. 9, when solenoid assembly 416 is deenergized.

Solenoid assembly 416 comprises a cup shaped housing 446 that has an annular bottom wall 450 which supports a hollow pole piece 452 of circular shape. Coil 454 is disposed in housing 446 and is secured to hollow pole piece 452.

An annular bearing plate 456 is embedded in an annular plastic cover 460 which is molded onto the open upper end of housing 446. Armature 404 is made of a magnetic material and is slidably disposed in the aligned bores of the annular bearing plate 456 and plastic cover 460 with its lower end projecting into coil 454. Armature 404 has a hollow body including a bore 465 which receives a push rod 466 which has an upper threaded end that is screwed into a threaded upper end 468 of armature 404. Push rod 466 extends through the hollow pole piece 452 and engages the top of the solid stem 407 of valve member 406. Solenoid assembly 416 further includes a cap 470 which fits onto an annular flange of plastic cover 460 to protect the projecting upper end of armature 404.

Valve mechanism 400 is incorporated in an exhaust gas recovery system by connecting it into a feed back circuit similar to that shown in FIG. 3. In this manner, inlet passage 422 communicates with the exhaust manifold 38 and outlet passage 424 communicates with intake manifold 31. When installed, solenoid assembly 416 is connected to an engine controller, such as controller 50 as illustrated schematically in FIG. 3.

Engine controller 50 controls the current to coil 454 of solenoid assembly 416 in a programmed manner so that armature 404 reciprocates in housing 446 axially moving valve member 406 toward and away from the valve seat 436 via push rod 466 and solid stem 440. When energized, coil 454 pulls armature 404 toward valve body 420 against the force of an expanding metallic bellows 402 moving valve member 406 and valve head 408 away from valve seat 436. This establishes communication from the chamber 444 of the expandable mechanism to the central chamber 424 so that exhaust gas flows from inlet passage 422 through the valve mechanism 400 and into intake manifold 31.

When coil 454 is deenergized, valve head 408 of valve member 406 is seated against valve seat 436 by the spring action of the contracting metallic bellows 402 thus blocking the flow of the exhaust gas past valve seat 436. In this closed position, the exhaust gas cannot flow into the central chamber 424. The exhaust gas in chamber 427 acts on end plate 410 of the metallic bellows 402 as well as valve head 408 of valve member 406 producing pressure forces that act in opposite directions. These pressure forces can be balanced precisely by sizing an inside surface area 474 of end plate 410 and the inside surface area 476 of valve head 408 so as to produce equal and opposite pressure forces acting on valve member 406.

Moreover, the vacuum side of EGR valve mechanism 400 can also be balanced precisely by properly sizing outside surface area 480 of end plate 410 and outside surface area 482 of valve head 408. Accordingly, equal and opposite vacuum pressure forces act on the valve member 406 when valve mechanism 400 is closed. Thus metallic bellows 402 not only provides an adequate spring force for closing valve member 406, but also forms part of the expandable mechanism that provides a pressure force balance and an exhaust pressure force balance when the valve mechanism 400 is closed.

Figure 10C:
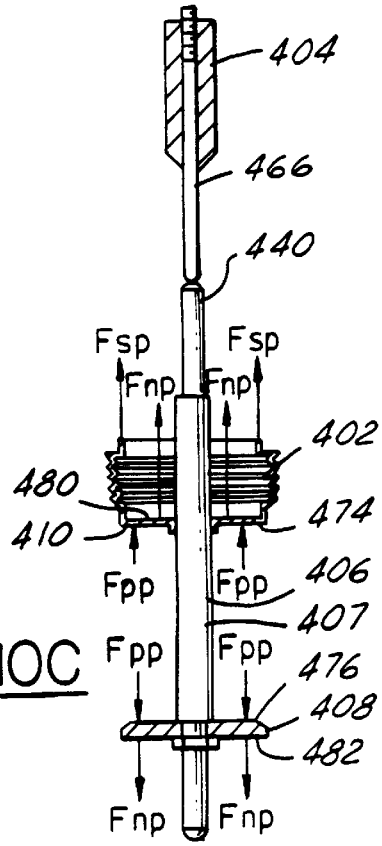

FIG. 10C illustrates the balanced forces on valve member 406 due to positive and negative relative pressures exerted on projected horizontal surfaces when valve mechanism 400 is closed. Negative pressure forces $F_{NP}$ pull downwardly on valve head 408 and upwardly on end plate 410 of bellows 402. Exhaust gas forces, or relative positive pressure forces $F_{PP}$, act on valve head 408 and end plate 410. By equating the projected horizontal surfaces of end plate 410 and valve head 408, valve mechanism 400 is relative insensitive to changes in exhaust gas or intake manifold pressures. The upward spring force $F_{SP}$ should be sufficiently large to keep valve head 408 seated against vibration related forces.

Figure 11A:
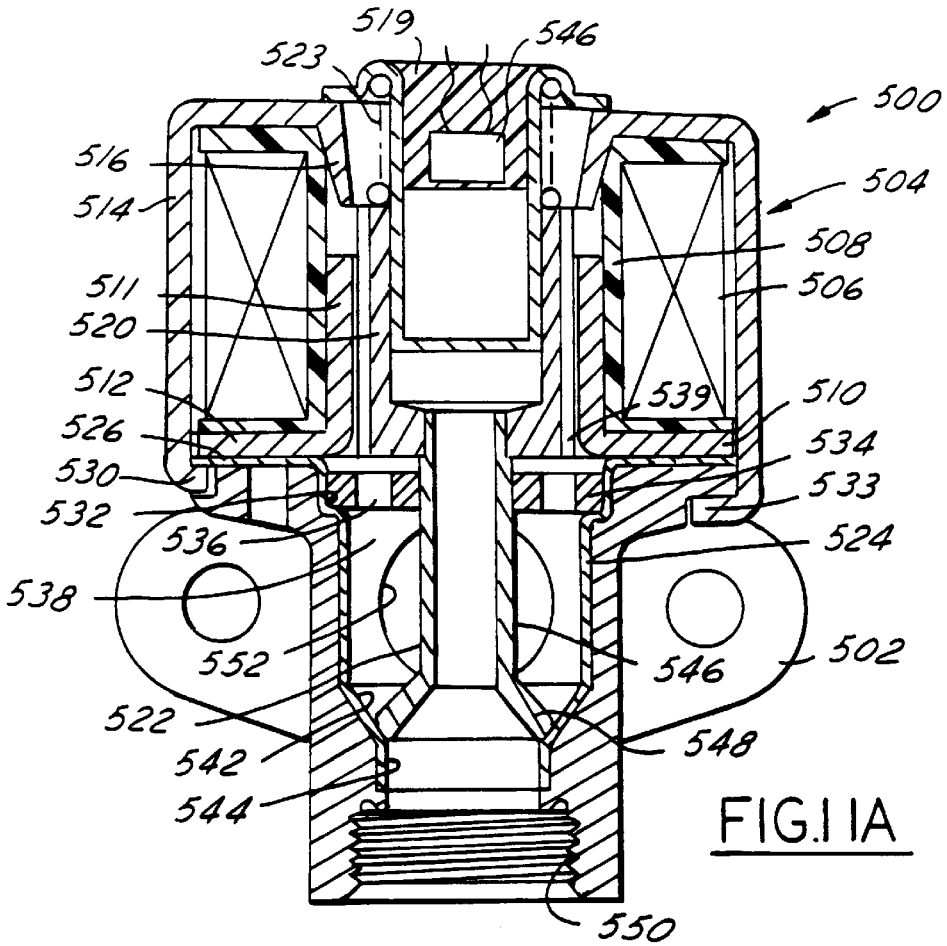
FIGS. 11A and B are cross-sectional and bottom views of a fourth embodiment of a pressure balanced solenoid valve mechanism including a preassembled solenoid subassembly mounting to a base housing.
Figure 11B:
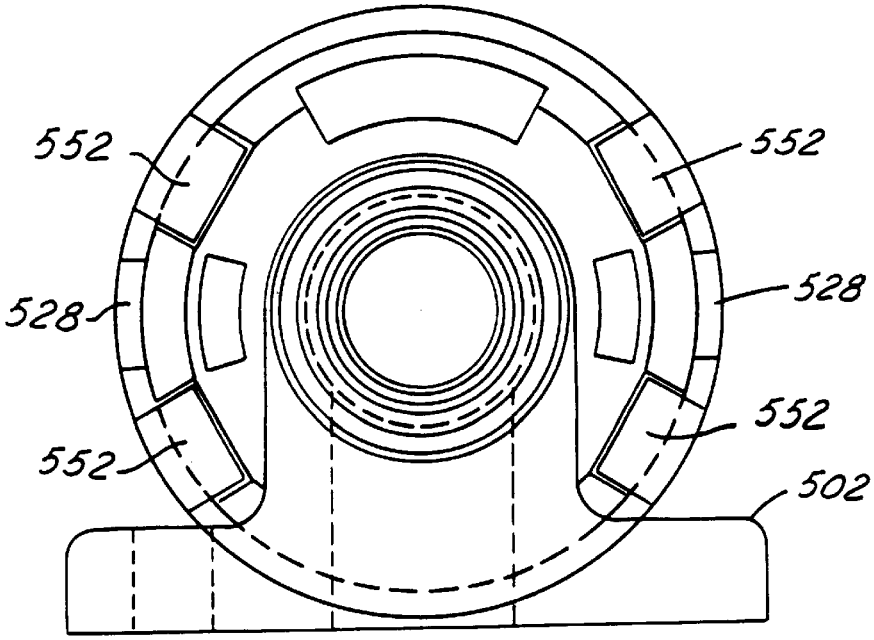

FIGS. 11A and 11B show a fourth embodiment of a pressure balanced solenoid actuated valve mechanism 500 made in accordance with the present invention. Solenoid valve mechanism 500 is pressure balanced in a manner similar to that described above with respect to valve mechanism 24.

Solenoid valve mechanism 500 comprises a base housing 502 to which a solenoid subassembly 504 is mounted. Subassembly 504 is preferably constructed, calibrated and tested prior to being mounted to base housing 502. The specific design of base housing 502 is adapted to meet the mating or mounting requirements of a particular engine. Therefore, only base housing 502 needs to be changed in order to mount solenoid subassembly 504 to a wide variety of engines. Alternatively, if a suitable mounting surface is provided on an engine, solenoid subassembly 504 can be directly mounted to the engine eliminating the need for base housing 502.

Solenoid subassembly 504 comprises a coil 506 held within a plastic bobbin 508. The combination of coil 506 and bobbin 508 is retained within an inner housing 510 which is L-shaped in cross-section having an inner wall 511 and a base wall 512. An outer housing 514 partially surrounds bobbin 508 and inner housing 510. Outer housing 514 has a downwardly depending annular portion 516 which extends downwardly toward inner wall 511 of inner housing 510. An inner sleeve 518, with a plastic cap 519 disposed in the top thereof, mounts to outer housing 514 adjacent downwardly depending portion 516. An armature 520 has a valve member 522 attached to its lower end. The inner surface of armature 520 is piloted upon sleeve 518. A spring 523 biases armature 520 and valve member 522 downwardly away from cap 519.

A stamped metal insert 524 has a radially extending top flange 526 captured between base wall 512 of inner housing 510 and a radially inwardly extending retaining flange 530 of outer housing 512. Insert 524 further has a shoulder 532 in which a bearing plate 534 is mounted. Bearing plate 534 has access holes 536 extending therethrough to provide communication between an internal chamber 538, in which valve member 522 reciprocates, and an annular space 539 defined between armature 520 and inner housing 510. Insert 524 further has a radially inwardly tapered wall 542 which serves as a valve seat. Finally, insert 524 has an annular terminal portion 544. Valve member 522 has a hollow stem 546 attached to armature 520 and a valve head 548 which seats against tapered wall 542.

Base housing 502 comprises an inlet opening 550 and an outlet opening 552 which is in communication with internal chamber 538. The inner surface of base housing 502 is configured to conform to the outer surface of insert 524 and provide support thereto.

In assembly, valve member 522 is placed through bearing plate 534 and affixed to armature 520. Bearing plate 534 is seated within shoulder 532 of insert 524. Inner housing 510 is positioned concentrically above insert 524. Next, bobbin 508 and coil 506 are placed radially about inner housing 510. Outer housing 514 is placed over bobbin 508 and top flange 526 of insert 524. As indicated in FIG. 11B, a pair of retaining flanges 528 on outer housing 514 are crimped to secure top flange 526 of insert 524 between retaining flange 528 and base wall 512 of inner housing 510. Next, spring 523 is placed above armature 520 and sleeve 518 is placed inside armature 520 capturing spring 523 between armature 520 and sleeve 518. Plastic cap 519 supports a field sensor 546, such as a magnetic flux or inductance field sensor. At this point, solenoid subassembly 504 is assembled and ready to be mated to base housing 502.

Field effect sensor 546 is then calibrated as described previously with respect to the field sensor 184. Before subassembly 504 is crimped or affixed to base housing 502, valve assembly 500 is calibrated. The calibration process requires energizing coil 506 to the maximum required stroke or flow. The test directly measures the flow or stroke with a LVDT (linear variable displacement transducer) or a flow meter. Then, the current to coil 506 is decreased to no stroke or flow. Concurrently, the correlation and calculation of the necessary offsets and/or slopes depending on the position sensor option, such as displacement or flow, are determined. Thereafter, the appropriate resistors are laser trimmed in order to obtain a desired voltage output vs. stroke (or flow) relationship. It is obvious that the other embodiments of the valve assemblies described in detail above and below can be similarly calibrated.

The control circuitry is then potted or sealed in order to protect critical electronic components from water, contamination, etc. This process minimizes stack up and manufacturing inconsistencies. It also allows for relaxed tolerances on components, resulting in lower cost. Lastly, the calibration helps customize output curves from the control circuitry 280 for each separate customer and at the same time, provides final test for each component before assembly to base housing 502. Preferably, all calibrations will be accomplished by laser trimming of resistors on the circuit board. Ideally, the circuit board is mounted adjacent the engine controller SO away from excessive engine heat.

After calibration, subassembly 504 is then mounted to base housing 502 by crimping four retaining flanges 552 on outer housing 512, as seen in FIG. 11B, to capture base housing 502 between retaining flanges 552 and top flange 526 of base insert 524. An advantage of this particular assembly procedure is that subassembly 504 can be calibrated and tested without base housing 502 being in place. Further, once subassembly 504 is calibrated, any one of a number of different configurations of base housings 502 can be utilized as long as it conforms to be crimped to solenoid assembly 504. This allows different base housings 502, which are compatible to different manufactures specifications, to be used with one generally identical subassembly 504. Alternatively, subassembly 504 may be directly crimped to a housing or mount on an engine thereby dispensing with the required base housing.

Figure 15:
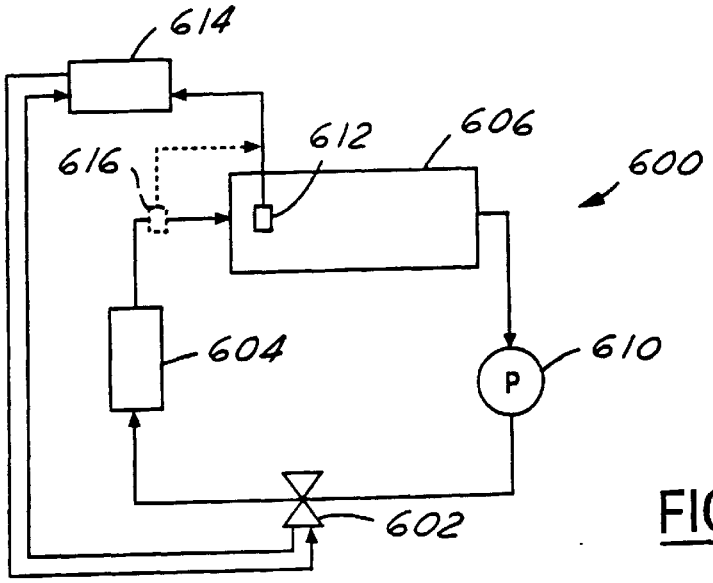
FIG. 15 is a schematic view of the present invention in a liquid cooling system.

The advantages of the above-described valve mechanisms 24, 300, 400 and 500 are not restricted to use only as EGR valves in vehicle engines. The pressure balance solenoid actuated valves may be used for other fluid control applications. For example, in another embodiment, the present invention is incorporated into a vehicle cooling system 600, as shown schematically in FIG. 15. The cooling system 600 includes a pressure balanced solenoid actuated valve mechanism 602, a radiator 604, an engine block 606 and a water pump 610. As the vehicle is operating, heat is transferred from the engine block 606 into water circulating therethrough. The water is pumped by water pump 610 through solenoid valve mechanism 602 to a radiator 604. Radiator 604, a conventional radiator, is used to release heat from the water to the surrounding atmosphere thereby reducing the temperature of the water flowing through the cooling system 600. Water from radiator 604 is returned to cool engine block 606 as needed.

In this embodiment, a block temperature sensor 612 is used to check the temperature of engine block 606. The temperature is sensed by temperature sensor 612 and that information is relayed to an engine control unit 614. Alternatively, engine control unit 614 can use a water temperature sensor 616 rather than the engine block sensor 612.

If the temperature is too low, a signal is sent from engine control unit 614 to the solenoid valve 602. In such a situation, the current to solenoid valve 602 would be limited thereby placing solenoid valve 602 in a closed position. Thus, heat will remain in the engine block 606 and not be carried away by the water to radiator 604.

When the temperature in engine block 606 has reached to a predetermined level, the control unit 614 will send a signal energizing solenoid valve 602. Solenoid valve 602 will then be increasingly opened to achieve the desired flow rate. Water flowing through radiator 604 will release heat and return water to engine block 606 at a reduced temperature.

Using solenoid valve mechanism 602, which is preferably made in accordance with one of the previously described embodiments of solenoid valve 24, 300 or 400 or 500, will allow cooling system 600 to enjoy the benefits provided by the pressure balanced solenoid valve mechanisms of the present invention. In particular, because the valve mechanisms are pressure balanced, relatively small springs can be used to keep the solenoid valves open or closed, depending upon their design, when the solenoid valve is not energized. When solenoid valve mechanism 602 is energized, only a relatively small current needs to be used to move the armature and valve member because solenoid valve mechanism 602 does not have to overcome or withstand internal pressures of the water flowing therethrough. Also, solenoid valve mechanism 602 can enjoy the benefit of enhanced controllability of a valve member therein due to the sensitive displacement readings provided by field sensors such as a Hall effect sensor or an inductance sensor in accordance with the present invention. Further, these sensors are unlikely to wear out since they have no mechanical moving parts. Moreover, they are easily calibrated during manufacture of the valve assembly and are relatively resistant to becoming uncalibrated. Another advantage of these valve mechanisms is that the solenoid assemblies can be reduced in weight making the solenoid valve mechanisms more economical to manufacture and, at the same time, lowering the overall weight of the vehicle.

Figure 16:
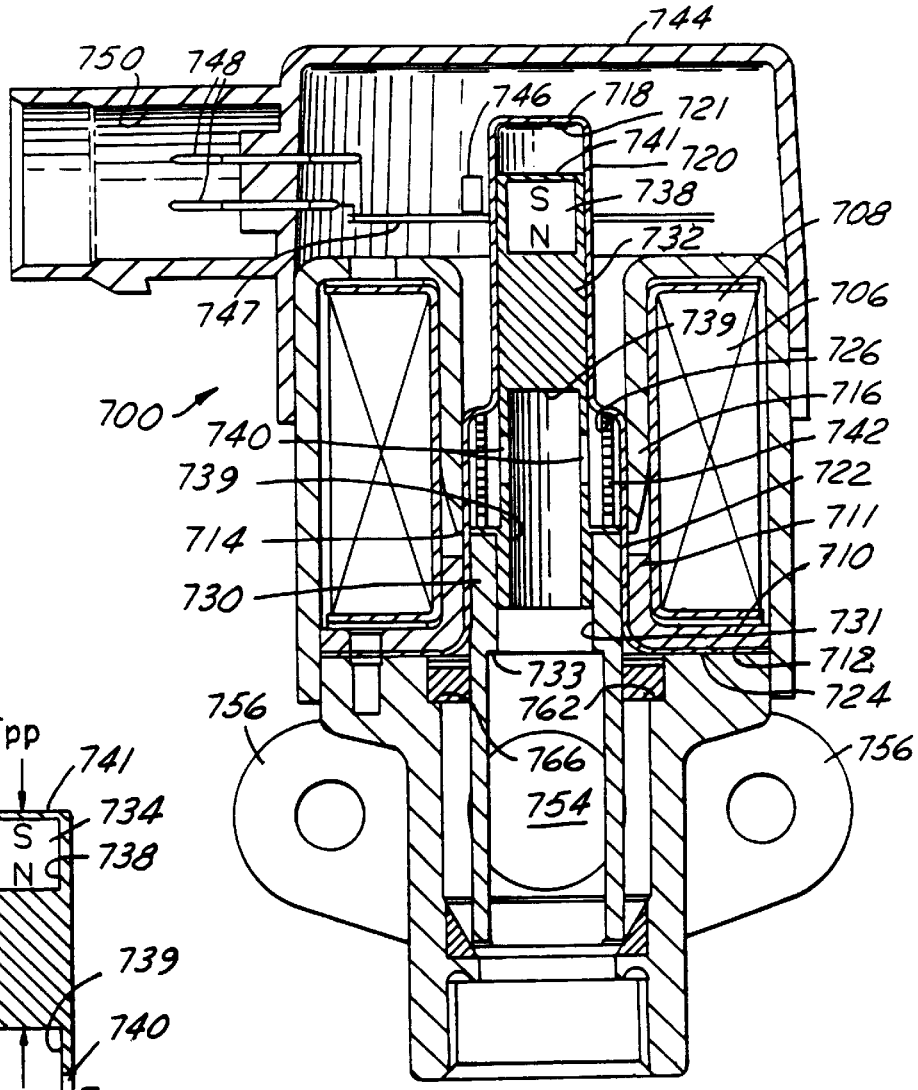
FIG. 16 is a cross-sectional view of a fifth embodiment of a pressure balanced solenoid actuated valve mechanism in accordance with the present invention.

FIG. 16 shows a fifth embodiment of a pressure balanced solenoid actuated valve mechanism 700 made in accordance with the present invention. Solenoid valve mechanism 700 comprises a base housing 702 to which a solenoid subassembly 704 is mounted. Subassembly 704 is preferably constructed, calibrated and tested prior to being mounted to base housing 702. The specific design of base housing 702, like base housing 502 of valve mechanism 500, is adapted to meet the mating or mounting requirements of a particular engine. Consequently, solenoid subassembly 704 may be used with a wide variety of base housings.

Solenoid subassembly 704 has a coil 706 held within a plastic bobbin 708. The combination of coil 706 and bobbin 708 is retained within an inner housing 710 which is L-shaped in cross-section having an inner wall 711 and a base wall 712. An outer housing 714 partially surrounds bobbin 708 and inner housing 710. Outer housing 714 has a downwardly depending annular portion 716 which extends toward inner wall 711 of inner housing 710. Inner and outer housings 710 and 714 cooperate to form an annular pole piece. An inner sleeve 718 has a first annular portion 720 with a closed end 721, a second larger diameter annular portion 722 and a radially outwardly extending flange 724. A radially extending step 726 is formed between first and second annular portions 722 and 724. Flange 724 of inner sleeve 718 is captured between inner housing 710 and base housing 702 when valve mechanism 700 is completely assembled.

An armature 730, a magnet holder 732 and a magnet 734 reciprocate within inner sleeve 718 and base housing 702. Armature 730 is hollow having a stepped inner bore 731 with a step 733. Magnet holder 732 has a disc-like outwardly extending flange 736, a magnet recess 738 at its upper end in which magnet 734 is held, a cavity 739 formed in the lower portion of magnet holder 732 and a pair of access openings 740 providing fluid communication between inner sleeve 718 and cavity 739. A cap 741 covers magnet recess 738. The exterior surface of magnet holder 732 is fluted in the axial or longitudinal direction to allow exhaust gas to freely pass between magnet holder 732 and the first annular portion 720 of inner sleeve 711. Alternatively, inner sleeve 718 may be oversized relative to the outer diameter of magnet holder 732 to accommodate fluid flow. Magnet 734 has north and south poles N and S, respectively. In the preferred embodiment, magnet 734 is a Samarium Cobalt (SmCo) magnet. Armature 730 is affixed to magnet holder 732 with flange 736 bearing upon the upper end of armature 732. A spring 742 is disposed between step 726 of inner sleeve 718 and flange 736 of magnet holder 732 biasing armature 730 and magnet holder 732 away from step 726 and armature 730 of valve assembly 700 closed.

A cover 744 affixes over outer housing 714. A Hall effect sensor 746 is mounted to a circuit board 747 and adjacent to magnet 734. The north and south poles N and S reciprocate along Hall effect sensor 746 during the operation of valve mechanism 700, as will be described in greater detail below. Also shown in FIG. 16 are a pair of electrical terminals 748 which communicate with engine controller 50. In actuality, there are five terminals, a lead and ground for coil 706 and three leads to Hall effect sensor 746. A connector housing 750 is formed in cover 744 to accommodate a connector (not shown) which plugs into cover 744 and electrically connects with terminals 748.

Base housing 702 has an exhaust gas inlet opening 752 and an outlet opening 754 formed therein. A pair of mounting ears 756 provide for attachment to an engine. Base housing 702 has an inner bore 760 with a first step 762 and a radially inwardly extending flange 764. A bearing collar 766 is held on first step 762 and serves as a guide for armature 730. A seat ring 768 rests upon flange 764 and is generally triangular in cross-section. A lower end 770 of armature 730 has a seal surface 772 which seals against seat ring 768 to control the flow of exhaust gas through inlet opening 752 of valve mechanism 700.

Figure 17:
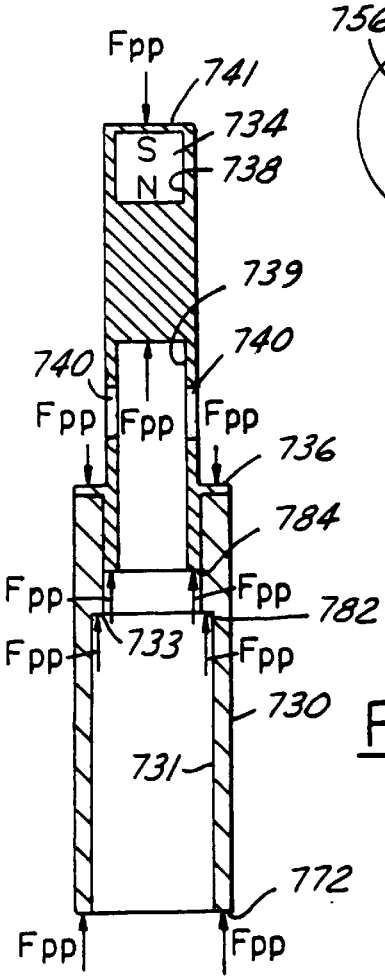
FIG. 17 is a free-body diagram of balancing forces acting on an armature and magnet holder of the valve mechanism of the fifth embodiment.

A free body diagram of vertical forces due to exhaust gas pressure acting on armature 730 and magnet holder 732 is shown in FIG. 17. Forces $F_{PP}$ act upwardly upon seal surface 772 and intermediate step 733 of armature 730, and on lower end 784 and the inner horizontal surface of cavity 739 of magnet holder 732. Exhaust gas pressure acts downwardly on flange 736 and cap 741 of magnet holder 732. Access openings 740 and flutes on the exterior of magnet holder 732 allow exhaust gas to readily reach flange 736 and cap 741 which are disposed within inner sleeve 718. The horizontal areas upon which the upward and downward forces act are generally equal in size. Consequently, as with the valve mechanisms described in the previous embodiments, valve mechanism 700 is generally pressure balanced and spring 742 can be of minimal size.

Figure 18:
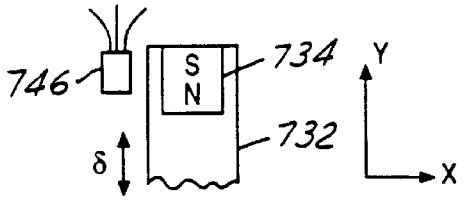
FIG. 18A is schematic view of a magnet reciprocating past a Hall effect sensor.

As schematically shown in FIG. 18, magnet 734 slides axially along Hall effect sensor 746 with the south pole S passing adjacent thereto when armature 730 is generally in a closed position and the north pole N passing thereby when armature 730 is near its full open position. The north pole N creates a positive flux while the south pole S produces an opposite or negative flux in the region surrounding Hall effect sensor 746. Hall effect sensor 746, as seen in FIG. 16, is positioned above coil 706 and inner and outer housings 710 and 714. Consequently, the magnetic flux produced due to electrical current running through coil 706 is negligible as compared to the flux produced by adjacent magnet 734.

Figure 19:
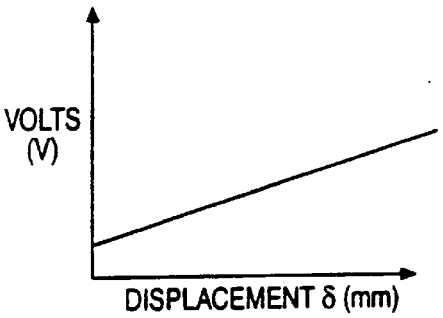
FIG. 19 illustrates that output voltage from a Hall effect sensor is linear with respect to movement of an armature, magnet holder and magnet mounted thereon.

Ideally, the voltage output from Hall effect sensor 746 varies generally between 0.5 and 4.5 volts with 2.5 volts being the output when no flux is sensed or when positive and negative fluxes are equal and balance one another out. A positive flux sensed by Hall effect sensor 746 provides an output greater than 2.5 volts while a negative flux decreases the voltage output from Hall effect sensor 746 to less than 2.5 volts. The Hall effect sensor 746 output voltage reflects the difference in magnetic flux between poles of magnet 734 which is linear as indicated in FIG. 19.

Hall effect sensor 746 is calibrated to produce a voltage output related linearly to the stroke or displacement of armature 730. Subassembly 704 is mounted to a test stand including a LDVT (Linear Variable Displacement Transducer). The LDVT is used to determine the position of armature 730 relative to a seat on the test stand similar to that found on a base housing 702.

Figure 20:
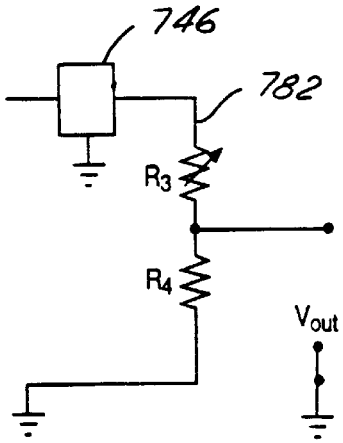
FIG. 20 is a schematic view of a Hall effect sensor passing current to a voltage divider.

Referring to FIG. 20, output from Hall effect sensor 746 is fed to a voltage divider 782 producing a conditioned output voltage which is recorded versus the displacement $\delta$ determined by the LDVT. Initially, with the armature 730 closed and the south pole S adjacent Hall effect sensor 746, a negative flux field is sensed by Hall effect sensor 746. Accordingly, an output voltage, i.e., 0.5 volts is output from voltage divider 782. Current in coil 706 is then increased until armature 730 is substantially near its maximum open position. The corresponding voltage output from voltage divider 782 is recorded against the sensed armature displacement δ. Curve 784 in FIG. 21 is an extrapolation between these two test values.

The variation in the flux field along magnet 734 is generally linear. Consequently, the voltage output from Hall effect sensor 746 over the stroke δ of armature 730 is also linear. It is desirable to calibrate valve mechanism 700 so that a predetermined slope m or volts/per unit displacement is established for valve assembly 700. Because the strength of magnets used and the tolerancing between components of valve assemblies 700 vary from valve mechanism 700 to valve mechanism 700, output from Hall effect sensor 746 is conditioned by voltage divider 782 to establish the desired slope m for the valve mechanism 700. Consequently, displacement of an armature 730 will be proportional, by the factor or slope m, to the corresponding change in voltage output from voltage divider 782 as a result of movement of armature 730.

The voltage divider 782, although not shown, is preferably mounted on circuit board 747. Placing circuit board 747 and components thereon away from coil 708 and isolated from exhaust gas within valve assembly 700 enhances the life and reliability of the control circuitry on circuit board 747.

Figure 21:
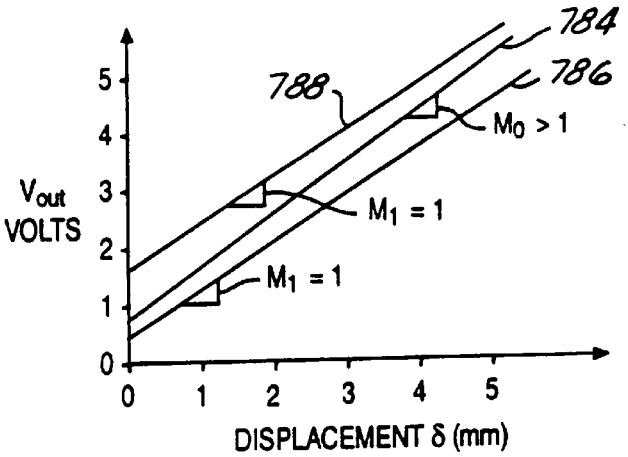
FIG. 21 illustrates the effect of using the voltage divider to change the slope of a voltage output versus armature displacement curve for voltage output from the arrangement of FIG. 20.

As seen in FIG. 21, line 784 represents the voltage output versus displacement curve prior to voltage divider 782 being adjusted. For example, a predetermined or desired value of slope $m_1$ may be chosen to be equal 1.0 volt/mm. Initially, the slope $m_0$ will be greater than 1.0 volt/mm. Voltage divider 782 is adjusted, preferably through laser trimming of a resistor R3, until $m_1$=1.0 volts/mm. Curve 786 has a conditioned slope of $m_1$, reduced from the unconditioned slope of $m_0$ of curve 784, which corresponds to the output from the untrimmed voltage divider 782. Of course, other values of $m_1$ could also be used as long as engine controller 50 is programmed with the correct value of $m_1$.

Similarly, all other valve assemblies 700 manufactured should have a calibration or slope of predetermined value $m_1$. This allows any of the valve assemblies 700 to be mounted to an engine and connected to a engine controller 50. The displacement of an armature 730 can then be determined by multiplying the change in voltage output ΔV by the inverse of the slope $1/m_1$.

$\delta = 1/m \cdot \Delta V$ where:

δ=displacement;

m=slope or calibration factor; and

ΔV=voltage−baseline voltage.

After valve assembly 700 has been operating in a vehicle for a long period of time, possibly years, contamination build-up may occur between the seats on armature 730 and seat ring 768. Consequently, armature 730 will not seat directly against seat ring 768 as was the case when valve assembly 700 was first manufactured. To accommodate this build-up, each time an engine starts, engine controller 50 takes a baseline reading of voltage output from voltage divider 784 when armature 730 is closed. With armature 730 seating upon the build-up, armature 730 will seat higher and the initial output from valve assembly 700 will be slightly greater than if the build-up were not present. However, the calibration factor or slope $m_1$ (volts/mm) of valve assembly 700 will remain constant. Curve 788 indicates that while the baseline voltage has increased due to the contamination, the slope $m_1$ will remain constant. Consequently, engine controller 50 can calculate the displacement from the seated position of armature 730 to any other position simply by multiplying the change in voltage ΔV from the baseline voltage by linear factor 1/m.

Again, the advantages to this type of Hall effect sensing technique is that there is no moving parts, other than the armature, magnet holder and magnet, and it is entirely non-contact. The system can be calibrated which helps make the valve mechanisms more manufacturable, and allows for tighter specifications. Calibration also allows for the use of different housing or casting styles.

Figure 22:
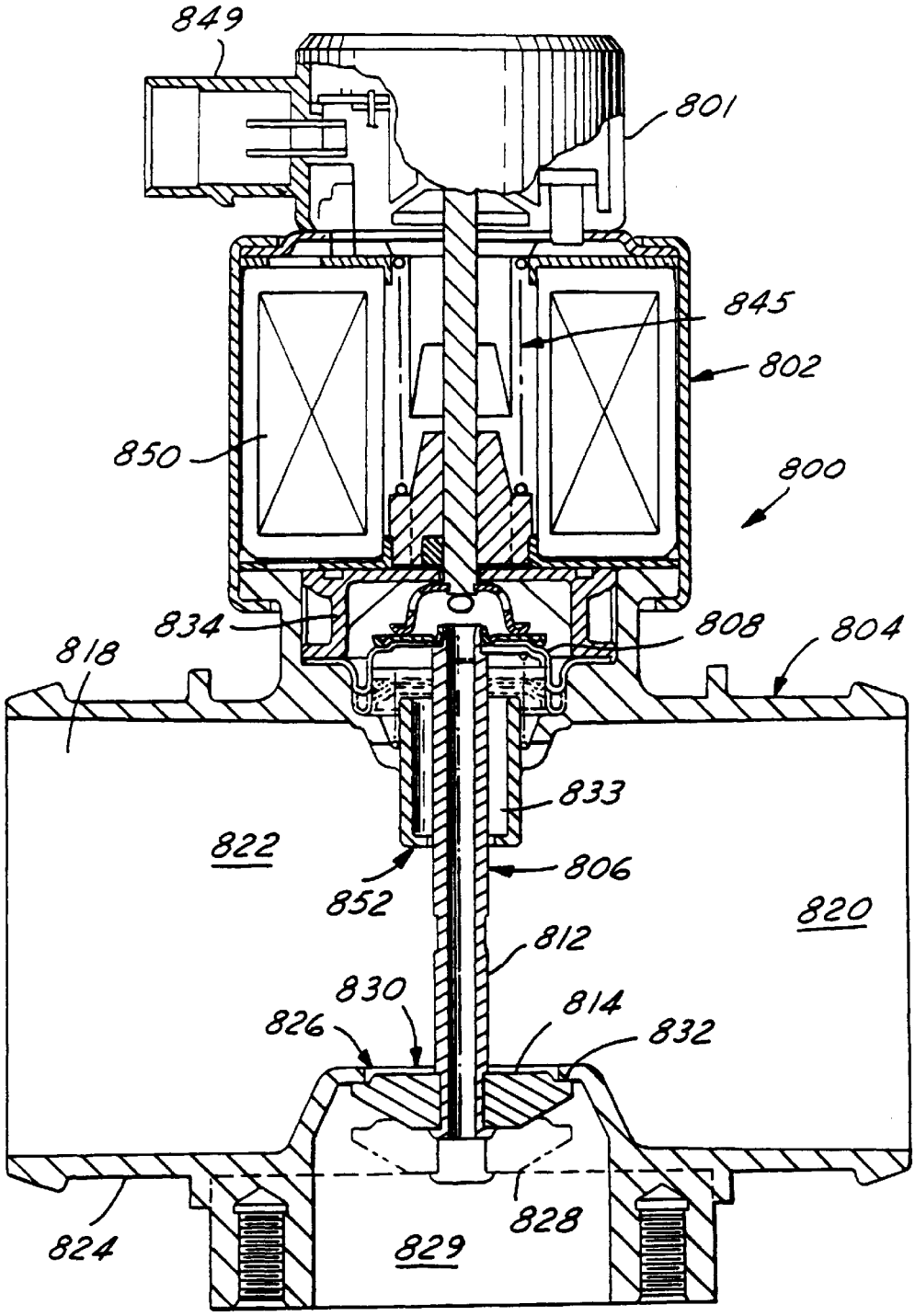
FIG. 22 is a cross-sectional view of another embodiment of a pressure balanced solenoid actuated valve mechanism in accordance with the present invention.
Figure 23:
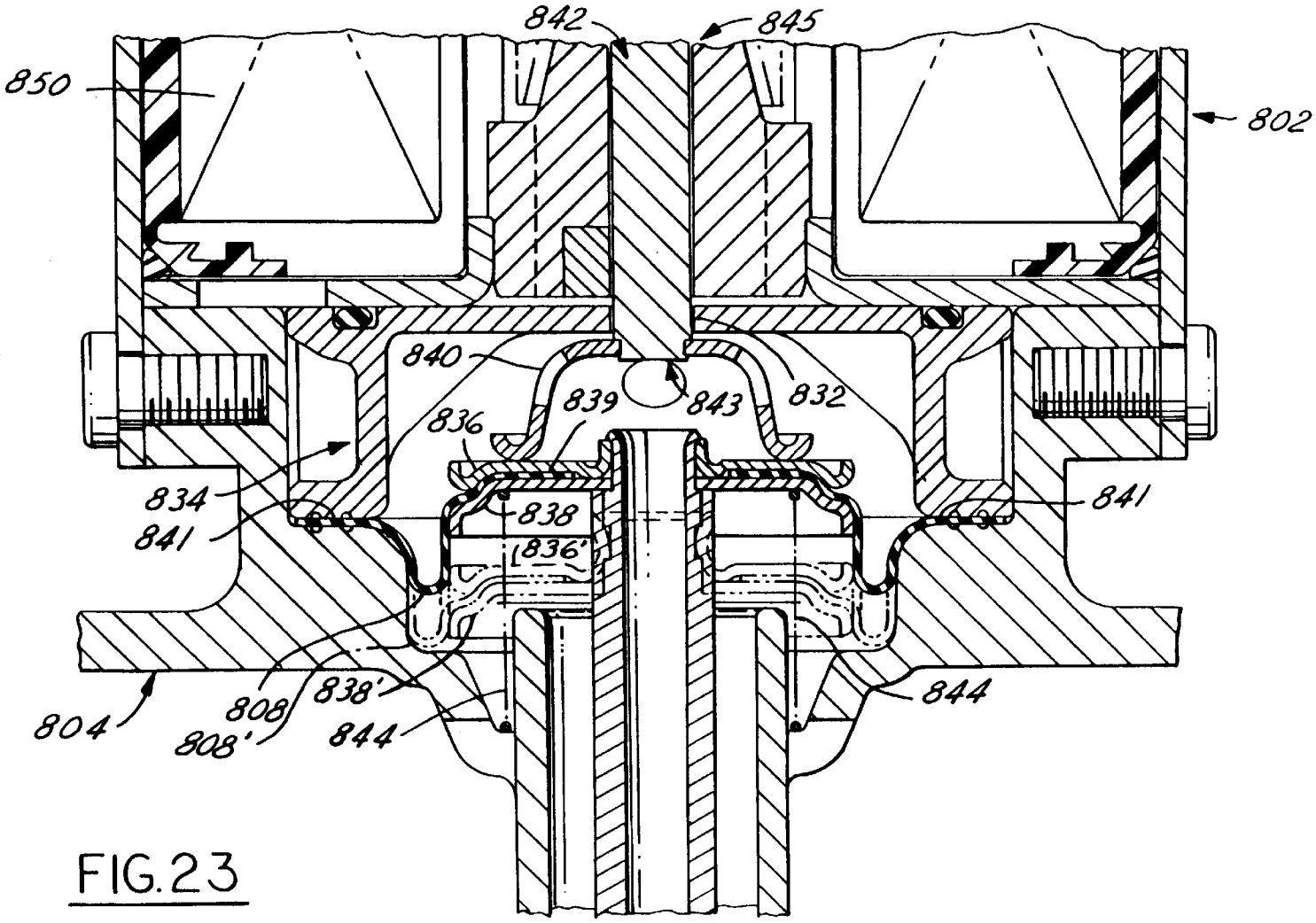
FIG. 23 is an enlarged view of a portion of the valve mechanism of FIG. 22 illustrating two positions of the diaphragm in accordance with a preferred embodiment of the present invention.

Turning now to FIGS. 22 and 23 which illustrate another embodiment of an EGR valve mechanism 800 in accordance with the present invention. The valve mechanism 800 includes a sensor housing 801, a solenoid housing 802, and a valve housing 804. The valve housing 804 includes a diaphragm 808 which is used to control movement of a valve member 806 and bias it into a closed position when the valve mechanism 800 is in a static state. The diaphragm 808 is preferably located below the valve housing 804 to provide a vertically moveable assembly which pressure balances the valve member 806 in its fully open and fully closed positions, as well as the various partially open positions therebetween.

As shown in FIG. 22, the solenoid assembly 802 is attached to the valve housing 804 for operating the moveable valve member 806. The valve member 806 includes a valve stem 812 and a valve head 814, the movement of which controls the flow of exhaust gas through the valve mechanism 800 when it is used as an EGR valve.

The valve housing 804 includes an inlet passage 818 and an outlet passage 820 both in communication with a central chamber 822. The central chamber 822 is defined in the valve housing 804 by the inner walls of a valve casing 824. When the valve head 814 is in the closed position, it engages a valve seat 832 to block the flow of exhaust gas through the valve opening in the casing 824 to the central chamber 822. When the valve member 806 is opened, the valve head 814 is pushed downward from a closed position 826, by the diaphragm 808, and the forces acting thereon, as discussed in detail below. The valve member 806 is moveable between the closed position 826 and a fully open position 828 (shown in lines). There are thus an infinite number of positions between the closed position 826 and the fully open position 828 through which the valve member 806 can be positioned.

When the valve member 806 is opened or pushed away from the valve seat 832, exhaust gas can pass from the exhaust gas passageway 829 through the valve opening 830 into the central chamber 822 where it is mixed with an air mixture that enters the central chamber 822 though the inlet passage 818. The air exhaust gas mixture then exits the central chamber 822 through the outlet passage 820 and travels to the intake manifold and to the cylinders.

The valve stem 812 is slidably disposed in housing bearings 833 supported in the side walls of the valve member 806. The valve member 806 can thus reciprocate in the valve housing 804 along a generally vertical axis as shown in FIG. 22. It should be understood, however, that the axis is merely referred to as being vertical for purposes of illustration only and may be oriented in any direction.

As shown in FIG. 23, the diaphragm 808 is disposed below the solenoid housing 802 and above the valve housing 804 in a diaphragm housing 834. The diaphragm housing 834 includes an upper diaphragm plate 836 lying generally on the inner portion 839 of the top surface of the diaphragm 808 and a lower diaphragm plate 838 lying generally on the inner portion 839 of the bottom surface of the diaphragm 808. The outer portion 841 of the diaphragm is sandwiched and secured between the valve housing 804 and the diaphragm housing 834. The upper diaphragm plate 836 is in communication with a diaphragm retainer 840 that limits the upward movement of the plates 836, 838. The diaphragm retainer 840 is in turn secured to a push rod 842 through an opening 843 in its center. The push rod 842 reciprocates in response to movement of an armature 845 in the solenoid assembly 810.

As shown in FIG. 22, the armature 845 and thus the valve head 814 are in the closed position 826 with the valve head pressed up against the valve seat 832. A return spring 844 is preferably positioned between the valve housing 804 and the lower retaining plate 838. The force of the return spring 844 is directed upwards to bias the valve 800, which is a push open valve, into the closed position 826. The force of the return spring helps achieve the necessary pressure balance in accordance with the present invention. When the push rod 842 is forced generally downward due to the action of the solenoid assembly 810, the diaphragm retainer 840, which is in rigid communication with the push rod 842, also moves generally downward against the force of the return spring 844. The force of the diaphragm retainer 840 overcomes the spring force and moves the upper diaphragm plate 836, and thus the diaphragm 808 and the lower diaphragm plate 838 downward. The force applied to the push rod 842 must be sufficient to overcome the biasing force of the spring 844 in order to move the diaphragm 808.

The action of the push rod 842 forces these components from a closed position illustrated in solid lines in FIG. 23 through a range of partially open positions to a fully open position 828. The fully open position is illustrated by the phantom lines. For example, the position of the diaphragm 808', the upper diaphragm plate 836', and the lower diaphragm plate 838' are shown by the phantom lines in FIG. 23. Through the movement of these components, the valve head 814 is moved away from the closed position 826 to allow exhaust gas to enter the central chamber 822. The amount that the valve head 814 is opened or pushed away from the valve seat amount of current passed through a wound coil 850 in the solenoid assembly 802.

Valve mechanism 800 is preferably incorporated into an exhaust gas recovery system by connecting it into a feed back circuit similar to that shown in FIG. 3. When installed, the solenoid assembly 802 is connected to an engine controller, such as the controller 50 schematically illustrated in FIG. 3. The engine controller 50 is in electrical communication with the valve sensor 849 to monitor the position of the armature 845 and thus the position of the valve member 806.

The solenoid assembly 810 includes a push rod 842 which is surrounded by and vertically moveable within wound coil 850. The amount of current applied to the coil 850 is controlled so that the armature 845 reciprocates axially moving the valve member 814 toward and away from the valve seat 832 via the push rod 842 and the valve member 806. When energized, the coil 850 pushes the armature 804 toward the valve body 812 against the force of the expanding diaphragm 802 and the spring 844 moving valve member 806 and valve head 814 away from the valve seat 826. When the coil 850 is deenergized, the valve head 826 of the valve member 806 is seated against the valve seat 832.

The exhaust gas in chamber 822 acts on end plate 852 as well as the valve head 826 of the valve member 806 producing pressure forces that act in opposite directions. These pressure forces are balanced in accordance with the present invention, as discussed above, and need not be reiterated herein. Further, to the extent the valve mechanism 800 contains other parts shown in the drawings but not specifically described in connection with this embodiment, they are the same function and structure as the similarly situated parts shown and described in connection with other embodiments.

The push to open valve of the present embodiment provides at least one advantage in a failure mode over the pull to open valves discussed above. This is partly because in the event that any part of this design clogs (i.e., the stem, the diaphragm retainer, etc.), the exhaust pressure, or flow forces, will naturally close the valve. The preferred failure mode of any EGR valve is that the valve be closed to ensure the engine will not stall or burn up from excessive exhaust gas flow. Further, the location of the diaphragm 808 below the solenoid assembly 802 helps reduce the amount of exhaust contaminants in the solenoid and sensor areas. It also helps reduce and prevent any high temperature at the coil and sensor area. This is specifically an advantage with regard to diesel engines which are generally known for large amounts of carbon build up, and thus any reduction of carbon is a significant advantage.

Another difference between this embodiment and the prior embodiments is the in-line casting design. With an in-line casing, the boost air from the intercooler can flow through the inlet opening 818 directly to the valve member 806. This allows the valve to have a cooler medium to help cool the solenoid and also cool the exhaust gas. Further, the desired air stream helps direct the exhaust gas charge directly into the boost air, hence reducing the amount of contamination of the stem and bearing area. Alternatively, this type of casting could also be manufactured to include the engine intake manifold and alternatively, the cylinder head.

Figure 24:
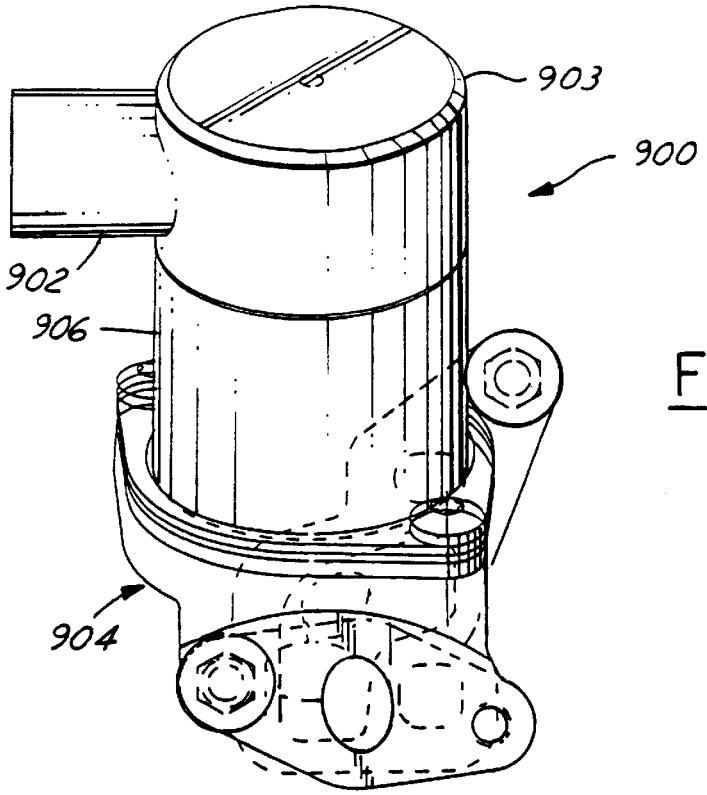
FIG. 24 is a perspective view of a preferred embodiment solenoid actuated valve mechanism in accordance with the present invention.
Figure 25:
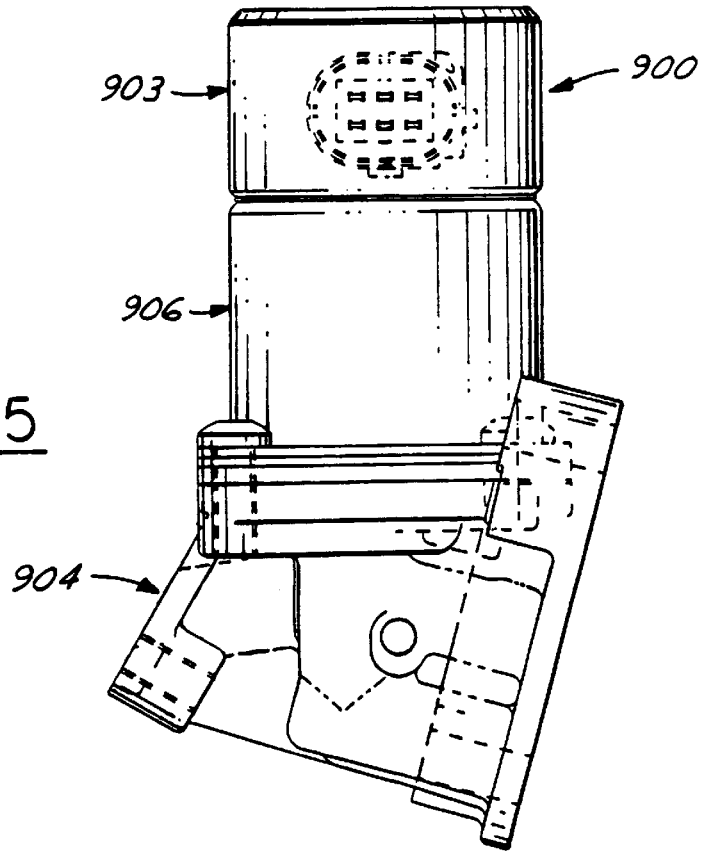
FIG. 25 is a side view of the solenoid activated valve mechanism shown in FIG. 24.
Figure 26:
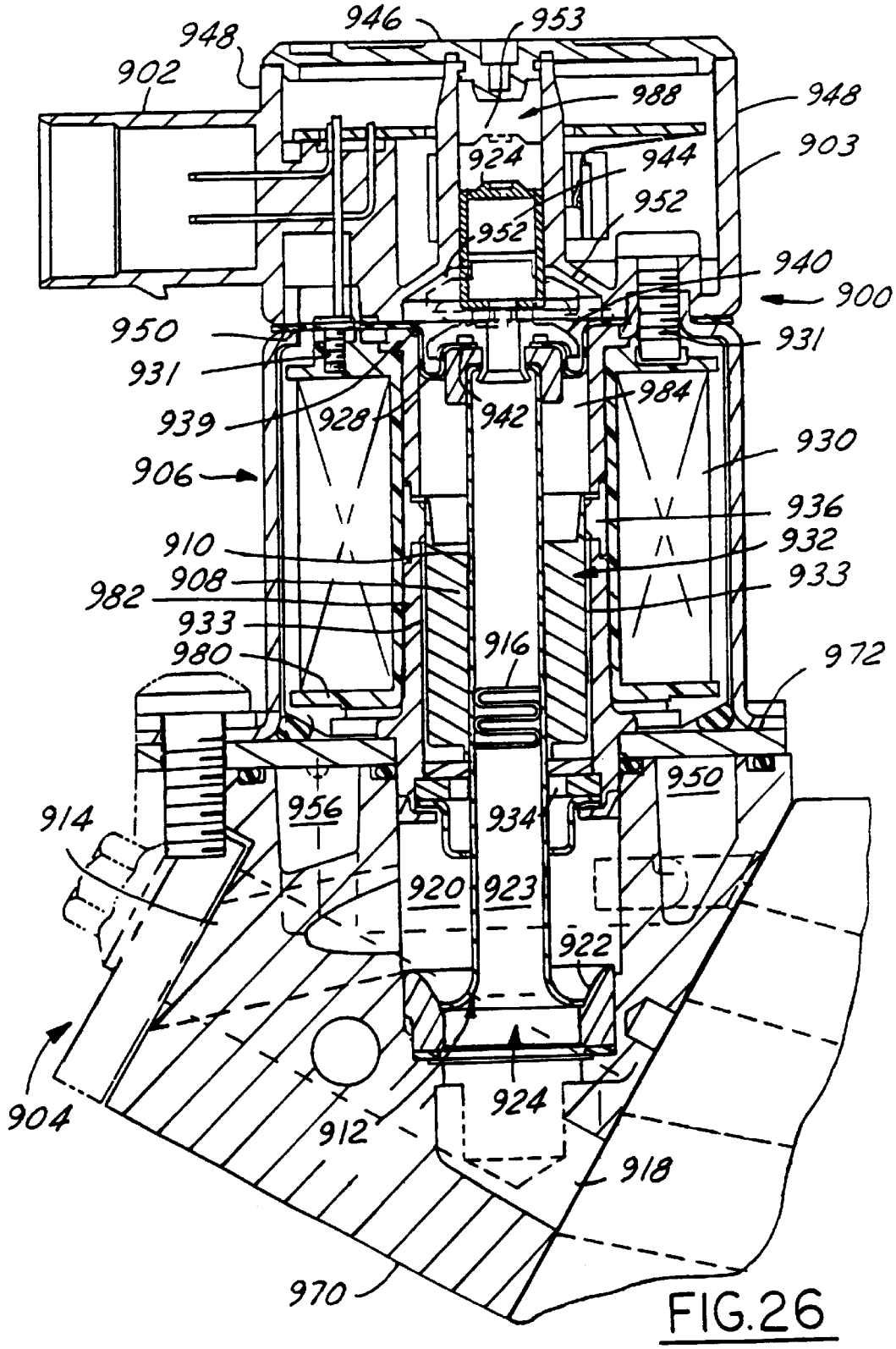
FIG. 26 is a cross-sectional view of another embodiment of a valve mechanism in accordance with a preferred embodiment of the present invention.

FIGS. 24 through 26 illustrate another embodiment of an EGR valve mechanism 900 in accordance with the present invention. The valve mechanism 900 includes a sensor 902, a sensor housing 903, a valve housing 904, and a solenoid assembly 906. The solenoid assembly 906 is attached to the valve housing 904 for operating a moveable valve member 908 and the sensor housing 902 is attached to the solenoid assembly 906 for detecting and controlling the movement of the valve member 908. The valve member 908 includes a valve stem 910 and a valve head 912 the movement of which controls the flow of exhaust gas through the valve mechanism 900.

As shown in FIG. 26, the valve housing 904 has an exhaust inlet passage 918 and an exhaust outlet passage 914. The exhaust inlet passage 918 is in communication with a central chamber 920 located within the valve housing 904 only when the solenoid is energized. The exhaust inlet passage 918 terminates at a valve seat 922. When the valve head 912 is in the closed position, it is in communication with the valve seat 922 to prevent exhaust gas from flowing from the exhaust inlet passage 918 into the central chamber 920. The exhaust outlet passage 914 is also in communication with the central chamber and funnels the exhaust gas downstream.

In operation, the valve stem 910 and valve head 912 reciprocate from the closed position to various open positions depending upon the amount of current applied to the solenoid assembly 906. The amount of current is controlled by a controller 50, such as described previously in connection with FIG. 3, which is based partly on the engine operating conditions. The varying positions of the valve head 912 allow varying amounts of exhaust gas to enter the central chamber 920 through the exhaust inlet passage 918. The exhaust gas that enters the central chamber 920 then travels out the exhaust outlet passage 914 for mixing with intake air downstream, and then through the manifold and to a cylinder as is described hereinabove.

The valve stem 910 is generally hollow has an internal passage 923 therein, and has at least one opening in its lower portion 924 allowing exhaust gas to flow into the internal passageway 923. The exhaust gas passes through the internal passageway 923 of the valve stem 910 and exits through an opening in its upper portion 926 and into communication with a diaphragm 928. The exhaust gas exerts a pressure on the top surface of the diaphragm 928 which is equal to and, thus in balance with, the pressure exerted on the bottom surface of the valve head 912 by the exhaust gas. As described hereinabove, other pressures are acting on the valve member 908, however, all pressure and vacuum forces are also balanced. This provides a stable valve 900 that will not jostle open when it is closed and will not fluctuate from one position to another while open. This insures that the proper amount of exhaust gas is allowed into the central chamber 920 and the engine will operate properly. The position of the valve stem 910 and valve head 912 is proportional to the amount of current in the wound coil 930. A labyrinth 916 is preferably included in the internal passageway 923. The labyrinth 916 separates the lower portion 924 of the valve stem 910 from the upper portion 926. The labyrinth 916 also helps reduce the temperature changes between the two portions 924, 926.

The wound coil 930 in the solenoid housing 906 is supported by a bobbin 980 which in turn is in communication with a steel flux tube 982. These elements surround and encapsulate the armature 932 and the valve stem 910 without any contact between the flux tube 982 and the armature 932 or valve stem 910. The armature 932 surrounds a portion of the valve stem 910 while a pole piece 984 which is secured to casing of the valve housing 904 and is located by the annular bearing 936.

The valve stem 910 is slidably disposed in a housing tube bearing 934 supported in the side walls of the steel flux tube 982. An annular bearing 936 is also disposed in the valve housing 904 and surrounds and supports the armature 932 and thus the valve stem 910. The annular bearing 936 assists in allowing the armature 932 to vertically reciprocate and also acts as a locator to position the armature 932 with respect to the steel flux tube 982 and the pole piece 984. The housing bearing 934 and the annular bearing 936 insure that the valve stem 910 and the armature 932 reciprocate vertically with respect to the valve housing 904 and do not become axially displaced. This arrangement ensures the valve head 912 is always in line with the valve seat 922 so that proper closure of the valve is effectuated when necessary. Prior valves have required more complex, more expensive structures to ensure proper valve closure.

This arrangement of the valve stem 910 in the valve housing 904 leaves a gap 933 between the outer surface of the armature 932 and the flux tube 982. The only contact of the armature 932 with the solenoid assembly 906 is at the annular ring 936 and the valve stem 910 only contacts the housing bearing 934. It is important to prevent the magnetic armature 932 from contacting the flux tube 982 and the pole piece 984 while properly supporting the valve stem 910 and ensuring proper closure of the valve head 914 with the valve seat 922.

The wound coil 930 is in electrical communication with the sensor housing 903 and thus the controller 50. The controller 50 determines and controls the amount of current that is applied to the wound coil 930 causing the valve stem 910 and armature 932 to reciprocate and the valve head 912 to engage and disengage the valve seat 922. The distance the valve head 912 is pulled away from the valve seat 922 (the amount the valve is open) is proportional to the amount of current applied to the coil 930.

As shown in FIG. 26, the diaphragm 928 is disposed in a diaphragm chamber 939 located in the solenoid assembly 906. The diaphragm 928 is surrounded by an upper diaphragm plate 940 lying generally on the top surface of the diaphragm 928 and a lower diaphragm plate 942 lying generally on the bottom surface of the diaphragm 928. The upper diaphragm plate 940 is in communication with a permanent magnet 944. The permanent magnet 944 which reciprocates in response to movement of the armature 932.

The permanent magnet 944 is positioned in the sensor housing 903 in a tower 988. As the valve stem 910 opens and travels upward, the permanent magnet 944 also moves upward. Conversely, when the valve is closed, the permanent magnet 944 is reciprocated downward. The position of the permanent magnet 944 and thus the valve is sensed to provide feedback to the valve as needed. The sensor housing 903 has a top surface 946, a pair of side surfaces 948, and a bottom surface 950 that is secured to the solenoid housing 906 by bolts 931 or the like. The sensor 902, which is preferably a Hall sensor or inductive sensor, as discussed in detail above, is attached to one of the side surfaces 948 of the sensor housing 903. Alternatively, the sensor 902 can also be attached to the tower 988 to sense the position of the permanent magnet 944. It should be understood, however, that any commercially available sensor may be employed.

The sensor housing 903 has an inner channel 953 within which the permanent magnet 944 vertically reciprocates. The movement of the permanent magnet 944 is limited by a spring (not shown) positioned between the top surface 946 of the sensor housing 903 and the permanent magnet 944. Additionally, a pair of passageways 952 allow exhaust gas from the diaphragm chamber 939 to pass therethrough and contact the upper surface 954 of the permanent magnet 944. Thus, the permanent magnet 944 is also pressure balanced to further balance the pressure and limit any unwanted variant movements of the valve stem 910 and valve head 912.

The valve housing 904 also preferably has at least one fluid conduit in heat transfer relationship therewith. As shown in FIG. 26, a cool fluid, such as water is passed through an inlet conduit into a fluid annulus at a first location 956 which is in a heat transfer relationship with the exhaust gas in the central chamber 920. The exhaust gas is cooled and the resultant warmer fluid exits by an outlet conduit in communication with the fluid annulus at a second location 958. The fluid annulus help keep the exhaust gas cool and helps protect the valve mechanism 900 from overheating.

Figure 27:
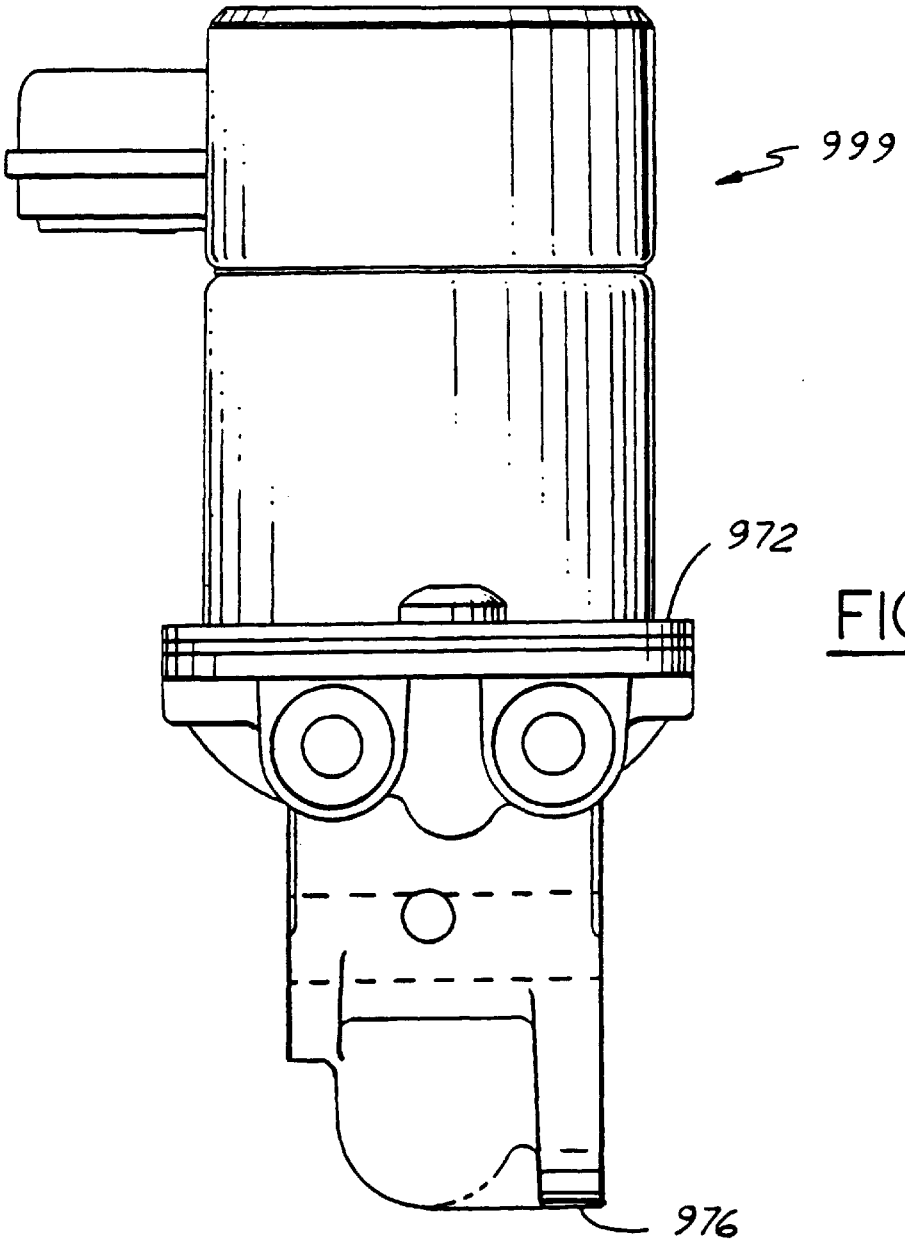
FIG. 27 is a perspective view of another embodiment of a solenoid actuated valve mechanism in accordance with the present invention.

FIG. 27 illustrates another embodiment of an EGR valve 999 in accordance with the present invention. Unlike the prior EGR valve 900 where the valve housing has bottom surface 970 that is angled with respect to the top surface 972, the bottom surface of the EGR valve 999 is parallel with respect to the top surface 972 which allows for attachment to various engines or at different locations on the same engine. Thus, the EGR valve of the present invention is modular and can be incorporated into almost any engine, regardless of its shape or configuration.

It should be understood that the solenoid operated valve may be used in any application, particularly those where weight is an important factor. For instance, the weight of an EGR valve can be reduced from about 3 pounds to about 1 pound utilizing the solenoid assembly of the present invention. Additionally, the solenoid current operating requirements can be reduced from about 3.0 amps to about 1.0 amps.

While preferred embodiments of the invention have been described hereinabove, those of ordinary skill in the art will recognize that these embodiments may be modified and altered without departing from the central spirit and scope of the invention. Thus, the embodiments described hereinabove are to be considered in all respects as illustrative and not restrictive, the scope of the invention being indicated by the appended claims, rather than by the foregoing descriptions, and all changes which come within the meaning and range of equivalency of the claims are intended to be embraced herein.

What is claimed is:

1. A solenoid operated exhaust gas recirculation valve for an internal combustion engine, comprising:

a valve housing having a central chamber, an inlet passage, an outlet passage, and an exhaust gas inlet passage having an inlet opening, each of said passages being in fluid communication with said central chamber;

a valve member positioned in and moveable within said central chamber, said valve member having a hollow valve stem and a valve head, said valve head having at least one opening formed therein to receive exhaust gas therethrough such that it can pass into said hollow valve stem;

a solenoid assembly for reciprocating said moveable valve member between a closed position wherein said valve head engages a valve seat located at said exhaust gas inlet opening to prevent the flow of exhaust gas from said exhaust gas inlet passage into said central chamber and a fully open position wherein said valve head is disposed from said valve seat allowing exhaust gas to flow from said exhaust gas inlet passage into said central chamber to mix with air flowing in from said inlet passage;

said valve member being subjected to an initial bias which produces a force tending to move the moveable valve member toward the closed position;

an expandable device that produces a force responsive to said initial bias to produce a force tending to urge the valve away from the closed position, said expandable device having an upper and a lower surface, whereby exhaust gas passing through said hollow valve stem, exerts a downward force on said upper surface of said expandable device to counteract the pressure exerted by the exhaust gas on said valve head, whereby at all positions of the valve member between the closed and fully open positions, the pressures acting on the valve member and the expandable device are equal so that said valve member remains in the desired position to allow the appropriate amount of exhaust gas to enter said central chamber.

2. The solenoid operated valve of claim 1, wherein said expandable device is a diaphragm.

3. The solenoid operated valve of claim 2, wherein said solenoid assembly comprises a wound coil which receives current from said engine controller to control the movement of the valve member and wherein the movement of the valve member is proportional to the amount of current in said wound coil.

4. The solenoid operated valve of claim 3, wherein said sensor is a Hall field effect sensor.

5. The solenoid operated valve of claim 3, wherein said sensor is an inductive sensor.

6. The solenoid operated valve of claim 3, wherein said moveable valve member moves away from said diaphragm to allow exhaust gas into said central chamber.

7. The solenoid operated valve of claim 6, wherein said diaphragm is positioned in a diaphragm chamber which is located between said valve housing and said solenoid assembly.

8. The solenoid operated valve of claim 7, wherein said valve stem is supported by a pair of bearings to align said valve stem with said valve seat.

9. The solenoid operated valve of claim 8, wherein said diaphragm is attached to said valve stem in said diaphragm chamber.

10. The solenoid operated valve of claim 9, wherein said diaphragm is in communication with a diaphragm retainer and moves in response thereto.

11. The solenoid valve of claim 10, wherein said solenoid assembly includes a push rod that reciprocates in response to excitation of said coil, said push rod being in communication with said diaphragm retainer.

12. The solenoid valve of claim 11, wherein said movement of said valve head away from said valve seat is proportional to the movement of said push rod.

13. The solenoid valve of claim 12, wherein said position of said push rod is sensed by said position sensor to determine the position of said valve member.

14. The solenoid valve of claim 13, further comprising a return spring that biases said valve toward said closed position.

15. The solenoid valve of claim 14, wherein said solenoid valve is intended for use in a diesel engine.

16. A solenoid exhaust gas recirculation valve, comprising:

a valve body having a central chamber, an exhaust inlet passage, an outlet passage, and a moveable valve member in said central chamber controlling the flow between said inlet passage and said outlet passage, said valve member including a valve stem and a valve head;

a solenoid assembly for reciprocating the moveable valve member between an open position and a closed position, wherein in said closed position said valve head contacts a valve seat located at the inlet of said exhaust gas inlet passage, said solenoid assembly including a wound coil, a bobbin in contact with one surface of said wound coil, and a flux tube in contact with a surface of said bobbin;

the valve member being subjected to exhaust gas in said closed position that produces a force tending to move the moveable poppet away from said closed position, said valve member including an armature attached to and encapsulating a portion thereof;

an expandable device which produces a force responsive to said exhaust gas pressure for generally equalizing the force tending to move the moveable valve member away from the closed position and maintaining the moveable valve member in said closed position;

said expandable device including an expandable chamber that is in fluid communication with the exhaust inlet passage when said valve member is closed; and said valve being configured such that a radial gap exists between said solenoid assembly and said armature for equalizing pressure in the solenoid.

17. The solenoid valve of claim 16, wherein an annular bearing is seated on said flux tube for vertically positioning said armature and thus said valve head.

18. The solenoid valve of claim 17, wherein said expandable device includes a diaphragm that provides a spring force acting on said valve member.

19. The solenoid valve of claim 18, wherein said valve member has a passageway formed therethrough that establishes fluid communication between said expandable chamber and said exhaust inlet passage.

20. The solenoid valve of claim 19, further comparing a sensor housing attached to said solenoid assembly.

21. The solenoid valve of claim 20, wherein said sensor housing includes a Hall effect sensor for monitoring the position of the armature and the valve member.

22. The solenoid valve of claim 20, wherein said sensor housing includes an inductance sensor for monitoring the position of the armature and the valve member.

23. The solenoid valve of claim 16, wherein said valve is incorporated for use in an internal combustion engine.

24. The solenoid valve of claim 23, wherein said outlet passageway transfers exhaust gas from said central chamber downstream to a mixing chamber for mixing with boost air for use in operating said engine.

25. The solenoid valve of claim 16, wherein said valve housing further comprises at least one fluid annula in fluid communication with said central chamber for cooling said exhaust gas.

26. A method of constructing and calibrating a solenoid valve assembly comprising:

slidably mounting an armature, including a wound coil, and poppet within a housing to form a solenoid subassembly;

mounting a position sensor within the housing;

placing the subassembly in a test chamber;

calibrating the position sensor to sense the position of the poppet by (a) energizing the coil to the maximum required poppet stoke and ensuring that the poppet is in a fully open position; and (b) deenergizing the coil to a no poppet stoke condition and ensuring that the poppet is in a closed position abutting the valve seat; and attaching the calibrated subassembly to a base valve housing which is configured to mount an engine.

27. The method of claim 26 further comprising:

crimping an insert to the outside of the housing prior to calibrating the position sensor.

28. A solenoid operated exhaust gas recirculation valve for an internal combustion engine, comprising:

a valve housing having a central chamber, an exhaust gas inlet passage having an inlet opening and an outlet passage both of said passages in fluid communication with said central chamber;

a valve member positioned in and moveable within said central chamber, said valve member having a valve stem and a valve head said valve stem including a passageway having an opening in communication with said exhaust gas inlet passageway;

a solenoid assembly for reciprocating said moveable valve member between a closed position wherein said valve head engages a valve seat located at said exhaust gas inlet passage into said central chamber and a fully open position wherein said valve head is displaced from said valve seat allowing exhaust gas to flow from said exhaust gas inlet passage into said central chamber;

said valve member being subjected to an initial pressure in said closed position which produces a force tending to move the moveable valve member away from said closed position;

an expandable device that produces a force responsive to said initial pressure to produce a force tending to urge said valve head away from the closed position said expandable device further having a pressure exerted thereon by said exhaust gas from said valve stem passageway to counteract the pressure exerted by the exhaust gas on said valve head, whereby at all positions of the valve member between the closed and fully open positions, the pressures acting on the valve member and the expandable device are equal so that the valve member remains in the desired position to allow the appropriate amount of exhaust gas to enter said central chamber; and a sensor housing attached to said solenoid housing and including a position sensor to monitor the position of said valve member, said position sensor being in communication with an engine controller which controls the movement of said valve member in response to operating conditions of said engine.

* * * * *